US008771115B2

(12) United States Patent
Berggren et al.

(10) Patent No.: US 8,771,115 B2
(45) Date of Patent: Jul. 8, 2014

(54) SPORT BALL WITH AN INFLATION-RETENTION BLADDER

(75) Inventors: Scott R. Berggren, Portland, OR (US); Mark McNamee, Portland, OR (US); Scott W. Johnson, Beaverton, OR (US); Eric L. Fliss, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 317 days.

(21) Appl. No.: 13/101,026

(22) Filed: May 4, 2011

(65) Prior Publication Data

US 2012/0283055 A1 Nov. 8, 2012

(51) Int. Cl.
*A63B 41/02* (2006.01)
*A63B 41/08* (2006.01)

(52) U.S. Cl.
USPC ..... 473/605; 473/610

(58) Field of Classification Search
USPC ..... 473/603–605, 610, 611
See application file for complete search history.

(56) References Cited

U.S. PATENT DOCUMENTS

| | | | | |
|---|---|---|---|---|
| 414,748 | A | | 11/1889 | Bentley |
| 1,517,859 | A | | 12/1924 | O'Shea |
| 1,575,281 | A | | 3/1926 | Rosenberg |
| 1,596,320 | A | | 4/1926 | Sonnett |
| 1,631,740 | A | | 6/1927 | Lawrence, Jr. |
| 1,641,382 | A | | 9/1927 | Goldsmith |
| 1,672,905 | A | | 6/1928 | Riddell |
| 1,872,459 | A | | 8/1932 | Knauer |
| 1,917,535 | A | | 7/1933 | Maynard |
| 1,923,890 | A | * | 8/1933 | Scudder ..... 473/610 |
| 1,932,226 | A | | 10/1933 | Pierce |
| 1,951,565 | A | | 3/1934 | Sonnett |
| 1,967,908 | A | | 7/1934 | Sneary |
| 1,990,374 | A | | 2/1935 | Goldsmith |
| 1,992,764 | A | * | 2/1935 | Perry ..... 473/610 |
| 1,994,790 | A | | 3/1935 | Roedding |
| 2,009,237 | A | | 7/1935 | McGall |
| 2,012,376 | A | | 8/1935 | Caro |
| 2,018,559 | A | | 10/1935 | Homer |
| 2,080,894 | A | | 5/1937 | Levinson |

(Continued)

FOREIGN PATENT DOCUMENTS

| | | |
|---|---|---|
| BR | 8503534 | 3/1987 |
| EP | 0598542 | 5/1994 |

(Continued)

OTHER PUBLICATIONS

International Search Report and Written Opinion mailed on Sep. 6, 2012 in PCT Application No. PCT/US2012/036121.

(Continued)

*Primary Examiner* — Steven Wong
(74) *Attorney, Agent, or Firm* — Plumsea Law Group, LLC

(57) ABSTRACT

A sport ball may include a casing, a bladder, and a valve. The casing forms at least a portion of an exterior surface of the ball. The bladder is located within the casing for enclosing a pressurized fluid, and the bladder may be formed from a material that includes a first layer of thermoplastic polymer material and a second layer of a barrier material. The valve is for introducing the fluid to the bladder, and the valve is secured to the bladder and accessible from an exterior of the casing. A tie layer may be located between the flange and a surface of the bladder to join the flange to the bladder.

25 Claims, 29 Drawing Sheets

(56) References Cited

U.S. PATENT DOCUMENTS

| | | | | | |
|---|---|---|---|---|---|
| 2,126,220 | A | | 8/1938 | Scudder | |
| 2,134,634 | A | * | 10/1938 | Goldsmith | 473/611 |
| 2,176,565 | A | * | 10/1939 | Boynton | 137/223 |
| 2,183,900 | A | * | 12/1939 | Voit et al. | 137/223 |
| 2,288,889 | A | * | 7/1942 | Costello | 473/611 |
| 2,300,441 | A | | 11/1942 | Voit et al. | |
| 2,325,073 | A | | 7/1943 | Reach | |
| 2,344,638 | A | | 3/1944 | Reeder | |
| 2,318,115 | A | | 3/1945 | Corson | |
| 2,671,633 | A | | 3/1954 | Corson | |
| 2,945,693 | A | | 7/1960 | Way | |
| 3,100,641 | A | | 8/1963 | Nichols | |
| 3,397,887 | A | * | 8/1968 | Caplan | 473/575 |
| 3,512,777 | A | | 5/1970 | Henderson | |
| 3,537,932 | A | | 11/1970 | Schrode | |
| 4,070,434 | A | * | 1/1978 | Noda | 264/255 |
| 4,154,789 | A | | 5/1979 | Delacoste | |
| RE30,103 | E | * | 9/1979 | Spector | 473/593 |
| 4,183,156 | A | | 1/1980 | Rudy | |
| 4,219,945 | A | | 9/1980 | Rudy | |
| 4,263,682 | A | * | 4/1981 | Bejarano | 473/610 |
| 4,436,276 | A | | 3/1984 | Donahue | |
| 4,513,058 | A | * | 4/1985 | Martin | 473/610 |
| 4,568,081 | A | * | 2/1986 | Martin | 473/611 |
| 4,610,071 | A | | 9/1986 | Miller | |
| 4,765,853 | A | | 8/1988 | Hoffman | |
| 4,842,563 | A | * | 6/1989 | Russell | 473/610 |
| 4,880,233 | A | | 11/1989 | Song | |
| 4,936,029 | A | | 6/1990 | Rudy | |
| 5,042,176 | A | | 8/1991 | Rudy | |
| D322,105 | S | | 12/1991 | Ma | |
| 5,096,756 | A | | 3/1992 | Walters | |
| 5,096,765 | A | | 3/1992 | Barnes | |
| 5,123,659 | A | | 6/1992 | Williams | |
| 5,181,717 | A | | 1/1993 | Donntag et al. | |
| 5,250,070 | A | | 10/1993 | Parodi | |
| 5,294,112 | A | * | 3/1994 | Smith | 473/610 |
| 5,306,001 | A | | 4/1994 | Shishido et al. | |
| 5,354,053 | A | | 10/1994 | Ratner et al. | |
| 5,494,625 | A | | 2/1996 | Hu | |
| 5,503,699 | A | | 4/1996 | Ratner et al. | |
| 5,593,157 | A | | 1/1997 | Koros et al. | |
| 5,603,497 | A | | 2/1997 | Louez | |
| 5,713,141 | A | | 2/1998 | Mitchell et al. | |
| 5,779,968 | A | | 7/1998 | Richwine et al. | |
| 5,888,157 | A | | 3/1999 | Guenther et al. | |
| 5,952,065 | A | | 9/1999 | Mitchell et al. | |
| 6,012,997 | A | | 1/2000 | Mason | |
| 6,013,340 | A | | 1/2000 | Bonk et al. | |
| 6,082,025 | A | | 7/2000 | Bonk et al. | |
| 6,127,026 | A | | 10/2000 | Bonk et al. | |
| 6,142,897 | A | | 11/2000 | Lees | |
| 6,203,868 | B1 | | 3/2001 | Bonk et al. | |
| 6,261,400 | B1 | | 7/2001 | Kennedy, III | |
| 6,302,815 | B1 | | 10/2001 | Shishido et al. | |
| 6,321,465 | B1 | | 11/2001 | Bonk et al. | |
| 6,461,461 | B2 | | 10/2002 | Kennedy, III | |
| 6,544,133 | B2 | | 4/2003 | Ou | |
| 6,582,786 | B1 | | 6/2003 | Bonk et al. | |
| 6,620,472 | B1 | * | 9/2003 | Shepard et al. | 428/35.4 |
| 6,629,902 | B2 | | 10/2003 | Murphy et al. | |
| 6,645,099 | B2 | | 11/2003 | Gaff et al. | |
| 6,685,585 | B2 | | 2/2004 | Shishido et al. | |
| 6,726,582 | B1 | | 4/2004 | Kuo et al. | |
| 6,846,534 | B2 | | 1/2005 | Bonk et al. | |
| 6,887,173 | B2 | | 5/2005 | Lacroix et al. | |
| 6,971,965 | B1 | | 12/2005 | Shishido | |
| 6,991,569 | B2 | | 1/2006 | Dobrounig | |
| 7,005,025 | B2 | | 2/2006 | Summers | |
| 7,029,407 | B2 | | 4/2006 | Lee et al. | |
| 7,066,853 | B2 | | 6/2006 | Chang | |
| 7,082,958 | B2 | | 8/2006 | Wang | |
| 2,073,766 | A1 | | 10/2008 | Suzuki | |
| 7,517,294 | B2 | | 4/2009 | Tsai | |
| 7,828,681 | B2 | | 11/2010 | Geisendorfer | |
| 2002/0077201 | A1 | * | 6/2002 | Davies | 473/604 |
| 2002/0086749 | A1 | | 7/2002 | Ou | |
| 2003/0203780 | A1 | | 10/2003 | Guenther et al. | |
| 2004/0077288 | A1 | | 4/2004 | Krysiak et al. | |
| 2004/0144477 | A1 | | 7/2004 | Taniguchi et al. | |
| 2004/0229722 | A1 | | 11/2004 | Liu | |
| 2005/0081982 | A1 | | 4/2005 | Chen | |
| 2005/0173000 | A1 | | 8/2005 | Wang | |
| 2005/0229985 | A1 | | 10/2005 | Saxenfelt | |
| 2006/0063622 | A1 | | 3/2006 | Nurnberg et al. | |
| 2006/0229149 | A1 | | 10/2006 | Goedoen | |
| 2006/0264278 | A1 | | 11/2006 | Horton et al. | |
| 2006/0293132 | A1 | | 12/2006 | Laliberty et al. | |
| 2007/0049434 | A1 | | 3/2007 | Maziarz et al. | |
| 2007/0105669 | A1 | * | 5/2007 | Maziarz | 473/604 |
| 2008/0051234 | A1 | * | 2/2008 | Nagao et al. | 473/604 |
| 2008/0299397 | A1 | | 12/2008 | Kenens et al. | |
| 2009/0325744 | A1 | | 12/2009 | Raynak et al. | |
| 2009/0325745 | A1 | | 12/2009 | Rapaport et al. | |
| 2010/0130315 | A1 | | 5/2010 | Steidle | |
| 2010/0130316 | A1 | | 5/2010 | Steidle | |
| 2010/0167851 | A1 | | 7/2010 | Burke | |
| 2010/0240479 | A1 | | 9/2010 | Raynak et al. | |
| 2011/0034840 | A1 | | 2/2011 | Broun (Wells) et al. | |
| 2011/0118065 | A1 | * | 5/2011 | Krysiak et al. | 473/603 |
| 2011/0183791 | A1 | * | 7/2011 | Lo | 473/605 |
| 2012/0283055 | A1 | | 11/2012 | Berggren et al. | |
| 2012/0283056 | A1 | | 11/2012 | Berggren et al. | |

FOREIGN PATENT DOCUMENTS

| | | |
|---|---|---|
| FR | 2572674 | 5/1986 |
| JP | 10337341 | 12/1998 |
| JP | 2004194860 | 7/2004 |
| WO | 9639885 | 12/1996 |
| WO | 2009158104 | 12/2009 |
| WO | 2012151278 | 11/2012 |
| WO | 2012151281 | 11/2012 |

OTHER PUBLICATIONS

International Search report and Written Opinion mailed Sep. 5, 2012, in PCT Application No. PCT/US2012/036128.
Office Action mailed Jul. 12, 2013, in U.S. Appl. No. 13/101,041.
Amendment filed Oct. 15, 2013, in U.S. Appl. No. 13/101,041.
Notice of Allowance dated Oct. 24, 2013, in U.S. Appl. No. 13/101,041.
Claims filed Nov. 28, 2013 in EP Application No. 12728859.5.
Claims filed Nov. 29, 2013 in EP Application No. 12728860.3.
Preliminary Amendment filed Dec. 20, 2013 in U.S. Appl. No. 14/136,474.

* cited by examiner

SPORT BALL WITH AN INFLATION-RETENTION BLADDER

BACKGROUND

A variety of inflatable sport balls, such as a soccer ball, football, and basketball, conventionally incorporate a layered structure that includes a casing, a restriction structure, and a bladder. The casing forms an exterior layer of the sport ball and is generally formed from a durable, wear-resistant material. In soccer balls and footballs, for example, the panels may be joined together along abutting edges (e.g., with stitching or adhesives). In basketballs, for example, the panels may be secured to the exterior surface of a rubber covering for the restriction structure and bladder. The restriction structure forms a middle layer of the sport ball and is positioned between the bladder and the casing to restrict expansion of the bladder. The bladder, which generally has an inflatable configuration, is located within the restriction structure to provide an inner layer of the sport ball. In order to facilitate inflation (i.e., with air), the bladder generally includes a valved opening that extends through each of the restriction structure and casing, thereby being accessible from an exterior of the sport ball.

SUMMARY

A sport ball is disclosed below as including a casing, a bladder, and a valve. The casing forms at least a portion of an exterior surface of the ball. The bladder is located within the casing for enclosing a pressurized fluid, and the bladder is formed from a material that includes a first layer of thermoplastic polymer material and a second layer of a barrier material. The valve is for introducing the fluid to the bladder, and the valve is secured to the bladder and accessible from an exterior of the casing.

A method of manufacturing a sport ball is also disclosed below. The method includes providing a bladder at least partially formed from a first thermoplastic polymer material. A valve at least partially formed from a second thermoplastic polymer material is also provided. The valve is thermal bonded to the bladder, and the bladder and at least a portion of the valve are located within a casing.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of sport balls, including a soccer ball, a football for American football, and a basketball. The concepts discussed herein may, however, be applied to a variety of other sport balls having inflatable or gas-retaining configurations, including footballs for rugby, volleyballs, water polo balls, exercise or medicine balls, playground balls, beach balls, and tennis balls, for example. Accordingly, the concepts discussed herein apply to a variety of sport ball configurations.

First Sport Ball Configuration

Figure 1:
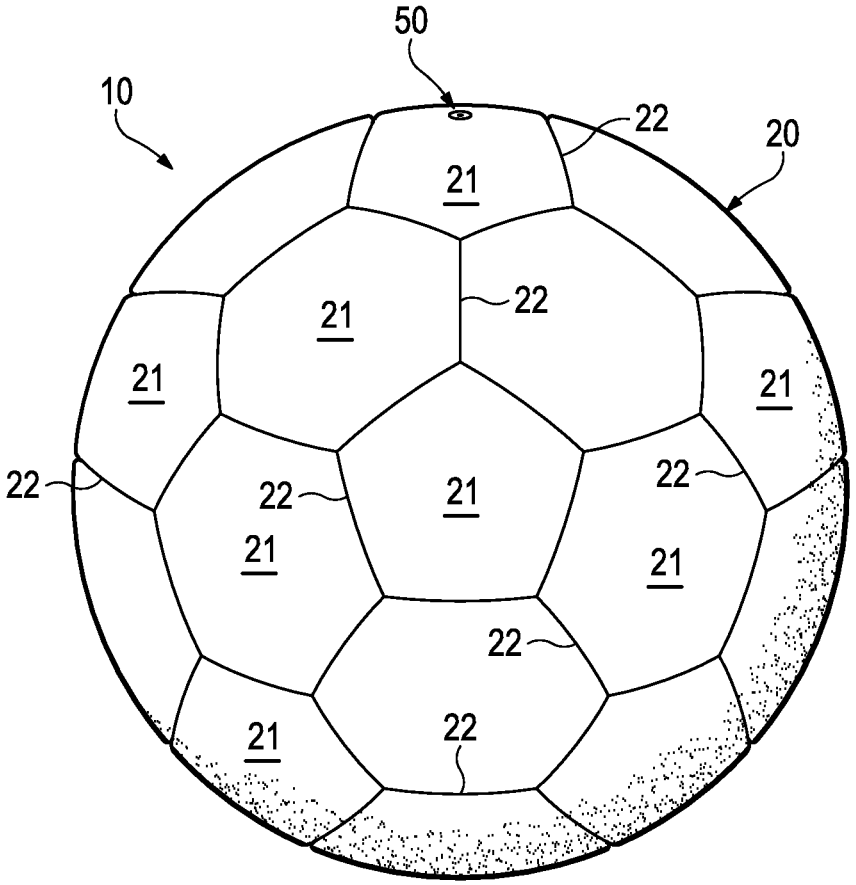
FIG. 1 is a perspective view of a first sport ball.
Figure 2:
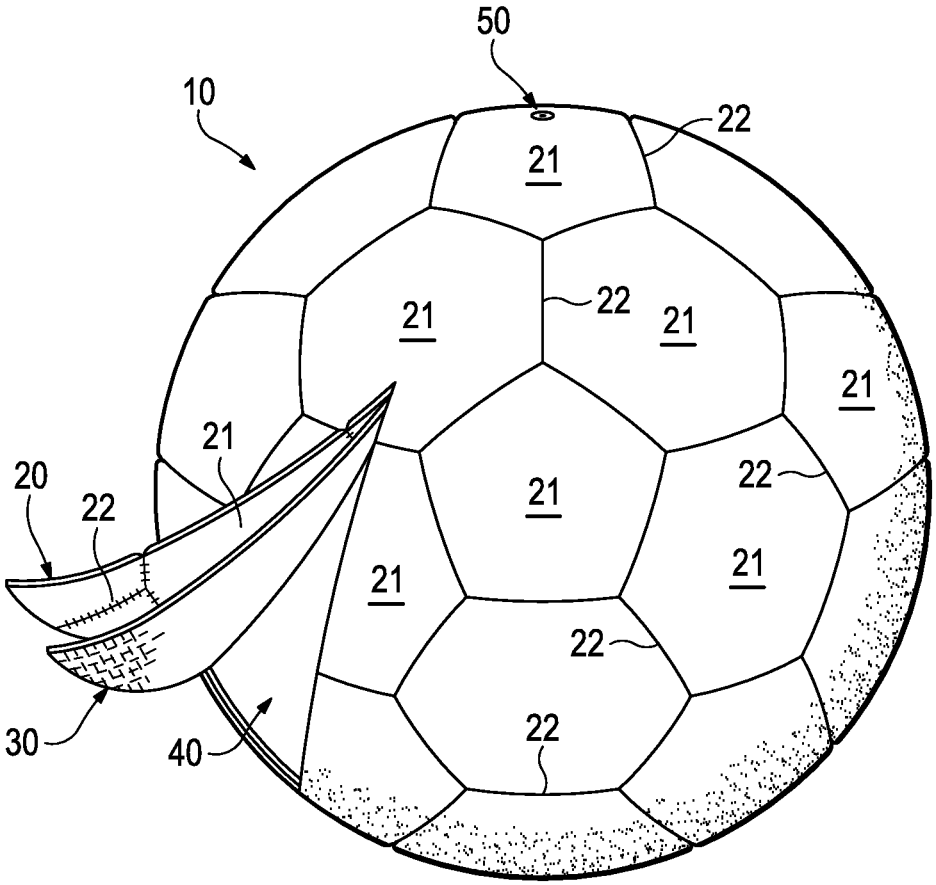
FIG. 2 is another perspective view of the first sport ball.

A sport ball 10 having the configuration of a soccer ball is depicted in FIGS. 1 and 2. Sport ball 10 has a layered structure that includes a casing 20, a restriction structure 30, and a bladder 40. In addition, sport ball 10 includes a valve 50. Casing 20 forms an exterior of sport ball 10 and is generally formed from various panels 21 that are stitched, bonded, or otherwise joined together along abutting sides or edges to form a plurality of seams 22 on an exterior surface of sport ball 10. Panels 21 are depicted as having the shapes of equilateral hexagons and equilateral pentagons. In further configurations of sport ball 10, however, panels 21 may have non-equilateral shapes, panels 21 may have concave or convex edges, and selected panels 21 may be formed integral with adjacent panels 21 to form bridged panels that reduce the number of seams 22, for example. Panels 21 may also have a variety of other shapes (e.g., triangular, square, rectangular, trapezoidal, round, oval, non-geometrical) that combine in a tessellation-type manner to form casing 20, and panels 21 may also exhibit non-regular or non-geometrical shapes. In other configurations, casing 20 may have a seamless structure (i.e., where all of seams 22 are absent). The materials selected for casing 20 may be leather, synthetic leather, polyurethane, polyvinyl chloride, or other materials that are generally durable and wear-resistant. In some configurations, each of panels 21 may have a layered configuration that combines two or more materials. For example, an exterior portion of each panel 21 may be a synthetic leather layer, a middle portion of each panel 21 may be a polymer foam layer, and a interior portion of each panel 21 may be a textile layer. Accordingly, the construction of casing 20 may vary significantly to include a variety of configurations and materials.

Restriction structure 30 forms a middle layer of sport ball 10 and is positioned between casing 20 and bladder 40. In general, restriction structure 30 is formed from materials with a limited degree of stretch in order to restrict expansion of bladder 40, but may have a variety of configurations or purposes. As examples, restriction structure 30 may be formed from (a) a thread, yarn, or filament that is repeatedly wound around bladder 40 in various directions to form a mesh that covers substantially all of bladder 40, (b) a plurality of generally flat or planar textile elements stitched together to form a structure that extends around bladder 40, (c) a plurality of generally flat or planar textile strips that are impregnated with latex and placed in an overlapping configuration around bladder 40, or (d) a substantially seamless spherically-shaped textile. In some configurations of sport ball 10, restriction structure 30 may also be bonded, joined, or otherwise incorporated into either of casing 20 and bladder 40, or restriction structure 30 may be absent from sport ball 10. Accordingly, the construction of restriction structure 30 may vary significantly to include a variety of configurations and materials.

Figure 3:
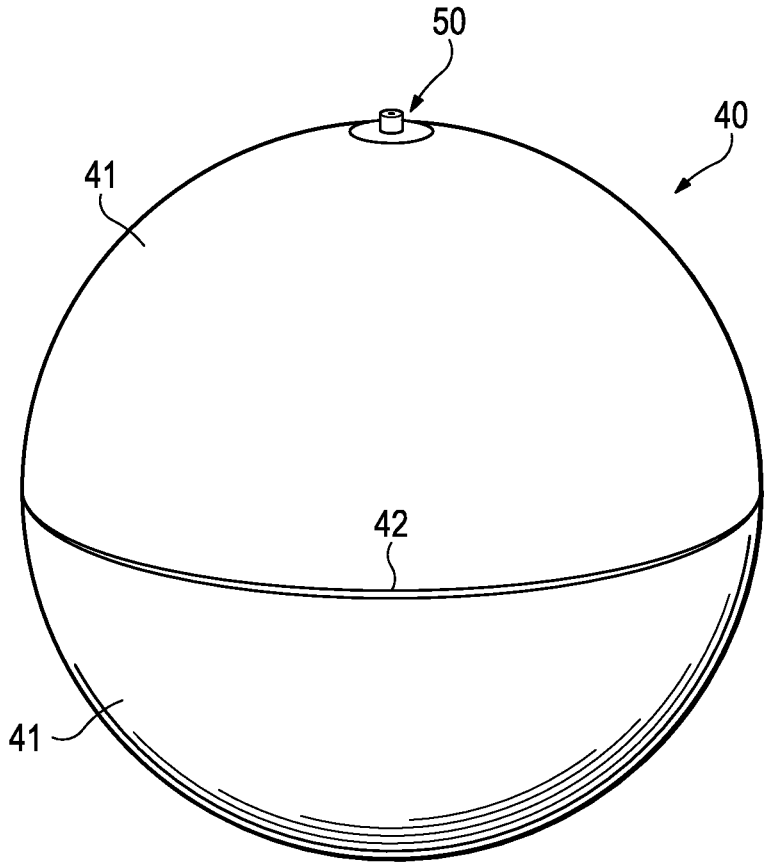
FIG. 3 is a perspective view of a bladder of the first sport ball.

Bladder 40 is located within restriction structure 30 to provide an inner portion of sport ball 10. As with conventional sport ball bladders, bladder 40 has a hollow configuration and is inflatable (e.g., through valve 50) to effectively pressurize the interior of sport ball 10. Referring to FIG. 3, bladder 40 is formed from two bladder elements 41 that are joined by a single circumferential seam 42. Bladder elements 41 each have a hemispherical shape. When joined by seam 42, therefore, bladder elements 41 provide a generally spherical aspect to bladder 40. In order to impart the hemispherical shape, bladder elements 41 may be polymer sheets that are thermoformed, molded, or otherwise manufactured to exhibit a rounded or hemispherical configuration. Once molded, bladder elements 41 are joined at seam 42. As an alternative, bladder elements 41 may be planar polymer elements that are joined at seam 42 and then pressurized to cause expansion and induce bladder 40 to take on the generally spherical shape.

The pressurization of bladder 40 with air or another fluid induces sport ball 10 to take on a substantially spherical shape. More particularly, fluid pressure within bladder 40 causes bladder 40 to place an outward force upon restriction structure 30. In turn, restriction structure 30 places an outward force upon casing 20. In order to limit expansion of bladder 40 and also limit tension in casing 20, restriction structure 30 is generally formed from a material that has a limited degree of stretch. In other words, bladder 40 places an outward force upon restriction structure 30, but the stretch characteristics of restriction structure 30 effectively prevent the outward force from inducing significant tension in casing 20. Accordingly, restriction structure 30 may be utilized to restrain pressure from bladder 40, while permitting outward forces from bladder 40 to induce a substantially spherical shape in casing 20, thereby imparting a substantially spherical shape to sport ball 10.

Figure 4A:
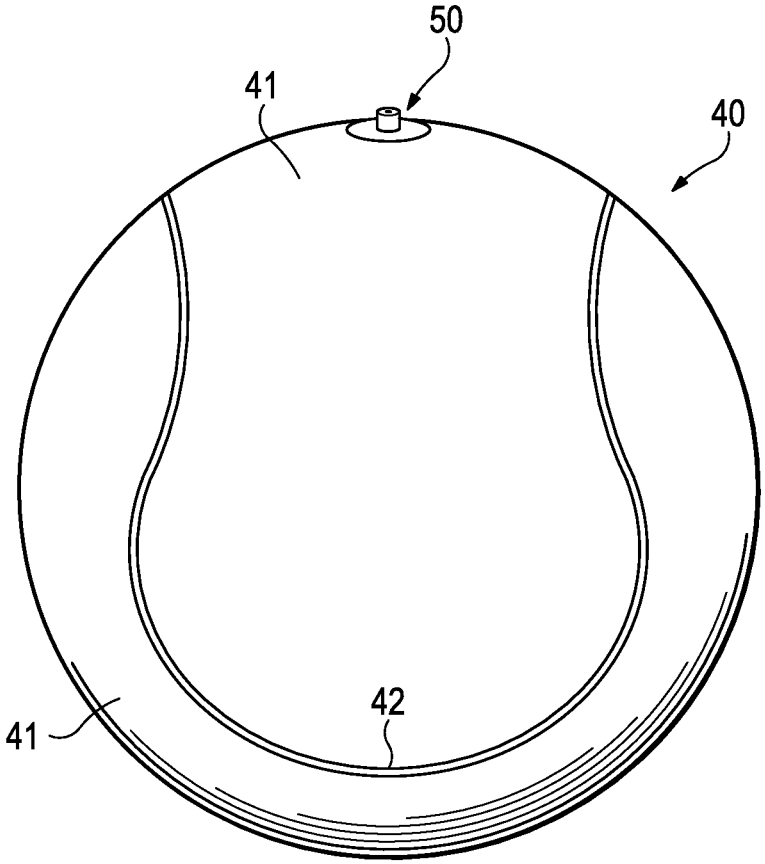
FIGS. 4A-4E are perspective views of additional configurations of the bladder.
Figure 4B:
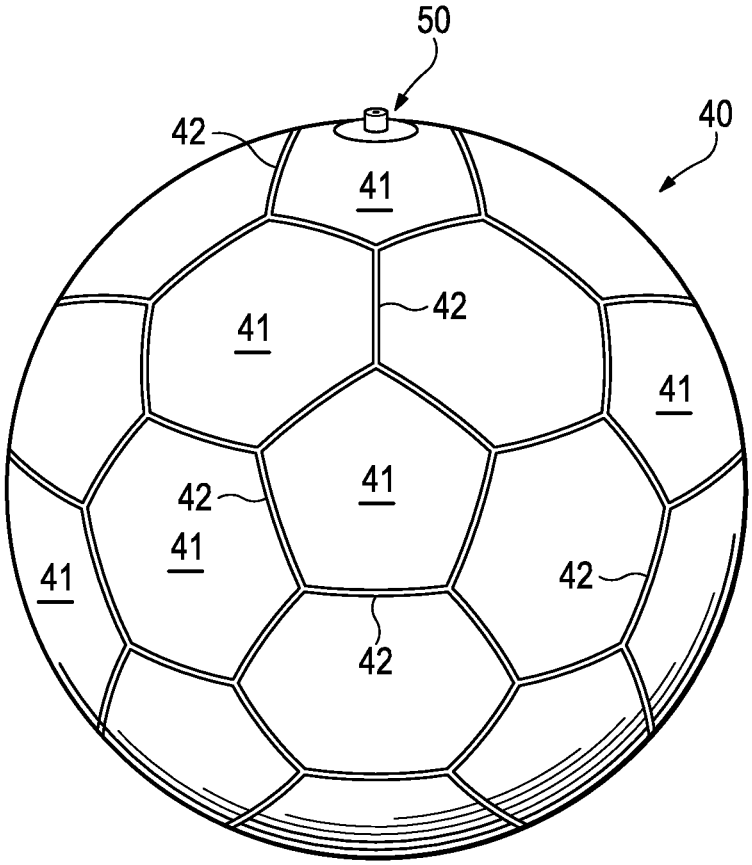
Figure 4C:
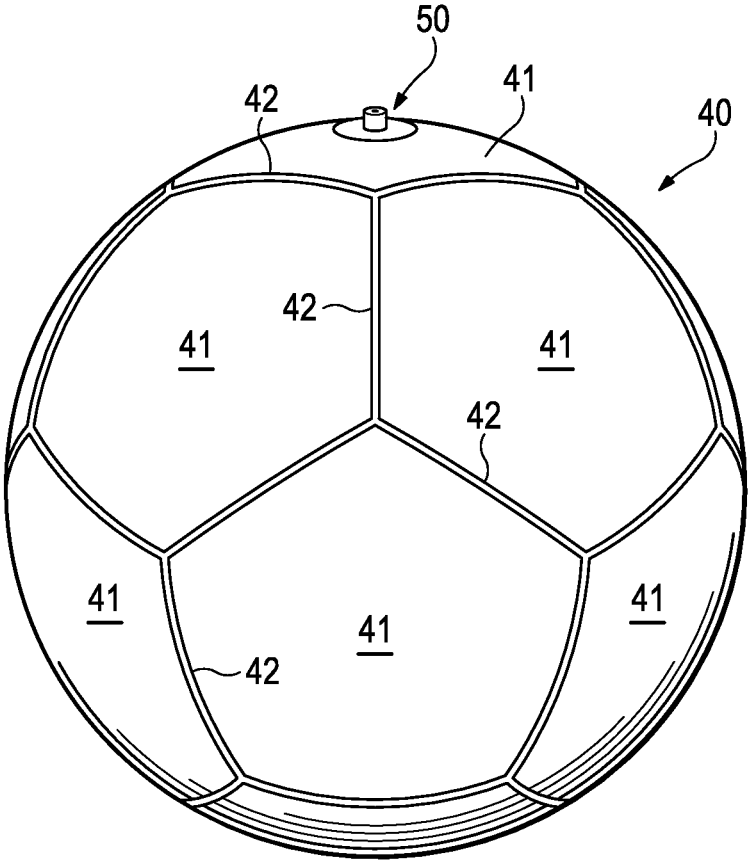
Figure 4D:
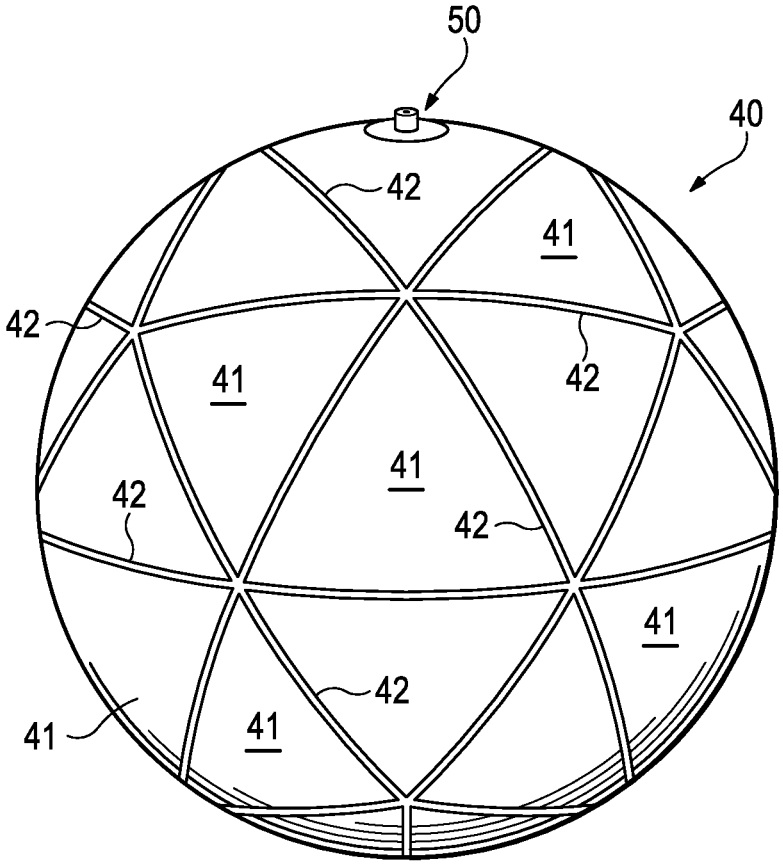
Figure 4E:
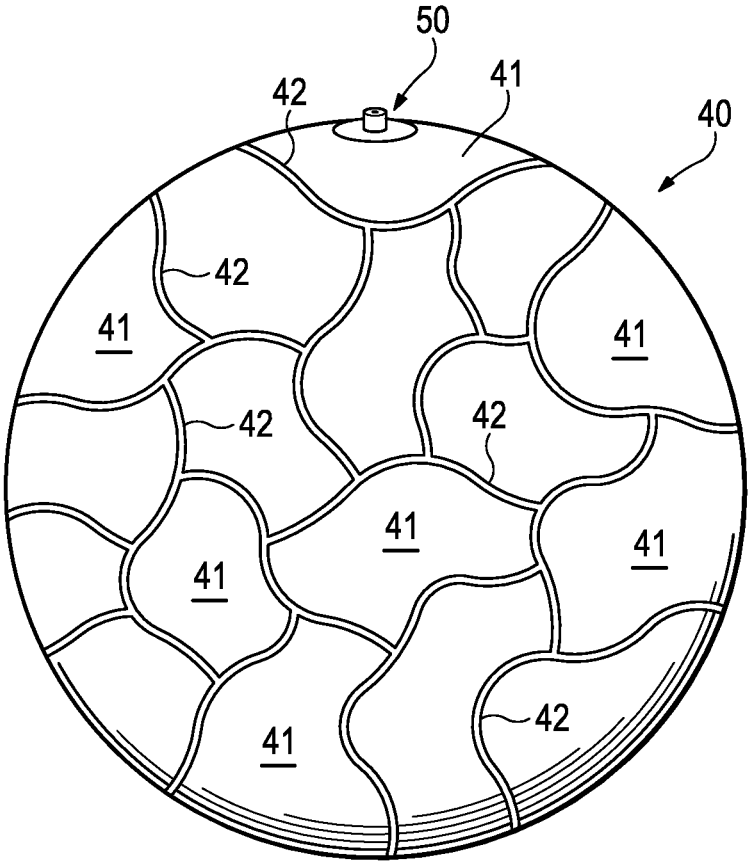

Although the configuration or FIG. 3 provides a suitable structure for bladder 40, bladder elements 41 and seam 42 may have a variety of other shapes. As an example, FIG. 4A depicts another configuration wherein bladder 40 incorporates two bladder elements 41 joined by a seam 42 having the general structure of a seam in a tennis ball or baseball. Bladder 40 may also be formed from a plurality of bladder elements 41 that have hexagonal and pentagonal shapes, as depicted in FIG. 4B, thereby imparting a configuration that is similar to casing 20. In other configurations, all of bladder elements 41 may all have pentagonal shapes, as depicted in FIG. 4C, or bladder elements 41 may all have triangular shapes, as depicted in FIG. 4D. Bladder elements 41 may also have non-geometrical or non-regular shapes, as depicted in FIG. 4E. Accordingly, bladder 40 may be formed to have a variety of configurations.

Figure 5:
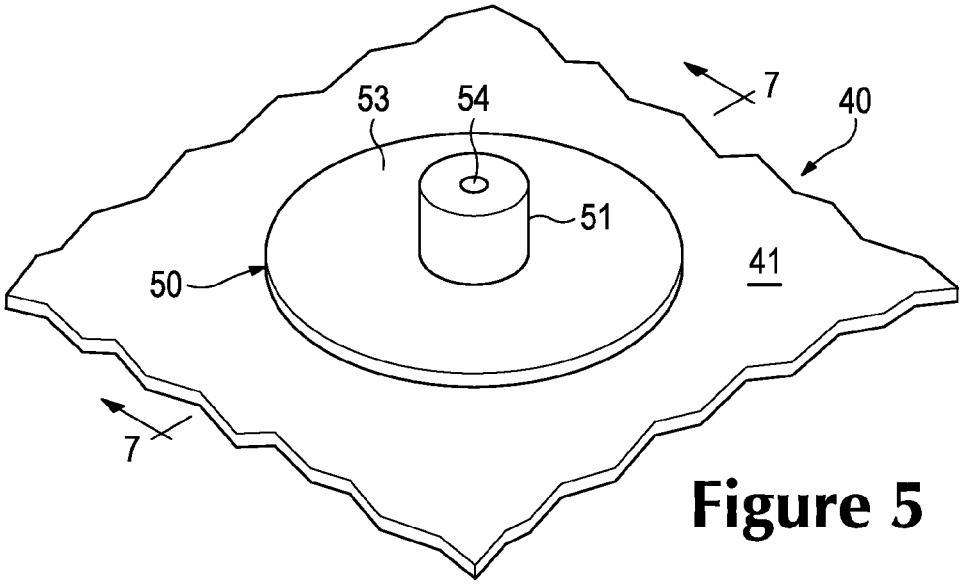
FIG. 5 is a perspective view of a first configuration of a portion of the bladder and a valve of the first sport ball.
Figure 6:
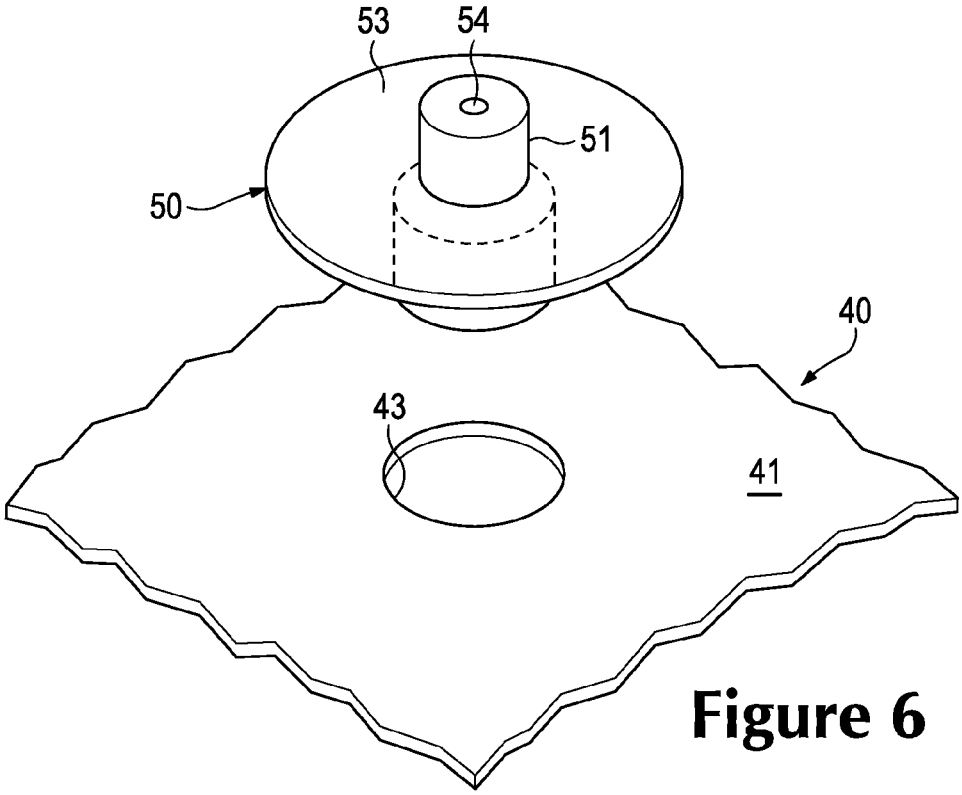
FIG. 6 is an exploded perspective view of the first configuration of the portion of the bladder and the valve.
Figure 7:
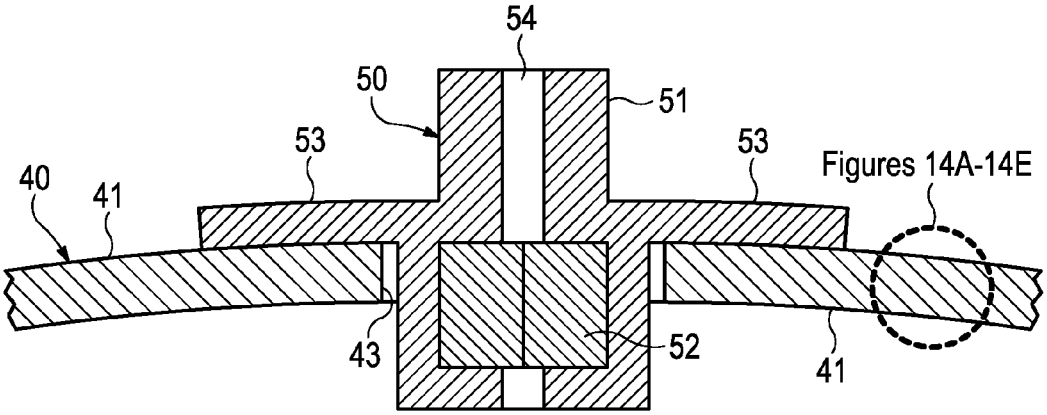
FIG. 7 is a cross-sectional view, as defined by section line 7 in FIG. 5, of the first configuration of the portion of the bladder and the valve.

Valve 50 is secured to one of bladder elements 41 and provides a structure through which air or another fluid may be introduced to bladder 40. That is, valve 50 may be utilized to pressurize the hollow interior of bladder 40. The configuration of valve 50 discussed herein is intended to provide an example of one possible valve configuration that may be utilized in sport ball 10 and other sport balls. The concepts discussed herein may, however, be applied to a variety of other valve configurations, whether of conventional or unconventional design. Referring to FIGS. 5-7, valve 50 and a portion of bladder 40 are depicted. Valve 50 includes a valve housing 51 and a valve insert 52. Valve housing 51 forms an exterior of valve 50 and includes a flange 53 and a channel 54. Flange 53 extends outward from a remainder of valve 50 and has a generally circular and planar configuration. As depicted in FIG. 7, flange 53 lays adjacent and parallel to bladder 40 and is secured to bladder 40. Channel 54 extends through valve housing 51 and forms an opening for interfacing with an inflation apparatus (e.g., a needle joined to a pump or air compressor). In addition, channel 54 forms an expanded area for receiving valve insert 52, which may be formed from rubber or silicone materials that seal to substantially prevent fluid from escaping bladder 40 through valve 50. That is, valve insert 52 permits the inflation apparatus to pressurize bladder 40 with the fluid, and valve insert 52 forms a seal to prevent the fluid from escaping.

A first portion of valve 50 protrudes outward from bladder 40 and may extend into restriction structure 30 and casing 20. Referring to FIG. 1, for example, valve 50 is visible through an aperture in casing 20 and may extend into the aperture to be flush with a surface of casing 20. As such, valve 50 is accessible through the aperture in casing 20 for introducing the fluid to bladder 40. Whereas a first portion of valve 50 protrudes outward from bladder 40, a second portion of valve 50 protrudes in an opposite direction and into bladder 40. Referring to FIGS. 6 and 7, bladder 40 forms an aperture 43 in the area where valve 50 is secured. As such, the second portion of valve 50 protrudes through aperture 43 and is located within bladder 40.

Valve-Bladder Bonding

A variety of bonding techniques may be employed to secure valve 50 to bladder 40. Examples of these bonding techniques, each of which will be discussed below, include thermal bonding, adhesive bonding, and the use of a bonding element. The specific bonding technique utilized to secure valve 50 to bladder 40 at least partially depends upon factors that include the materials forming each of valve 50 and bladder 40. More particularly, the bonding technique utilized to secure valve 50 to bladder 40 may be selected based upon the materials forming flange 53 and an outer surface of bladder 40.

An example of valve 50 being secured to bladder 40 with thermal bonding is depicted in FIGS. 5-7. In this configuration, flange 53 lays parallel to the outer surface of bladder 40 and in contact with the outer surface of bladder 40. Thermal bonding may be utilized when one or both of flange 53 and the outer surface of bladder 40 incorporate thermoplastic polymer materials. Although a strength of the bond between valve 50 and bladder 40 may be sufficiently strong when only one of flange 53 and the outer surface of bladder 40 includes a thermoplastic polymer material, the bond may exhibit greater strength when both flange 53 and the outer surface of bladder 40 are formed from compatible (i.e., readily thermal bondable) thermoplastic polymer materials.

As utilized herein, the term "thermal bonding" or variants thereof is defined as a securing technique between two elements that involves a softening or melting of a thermoplastic polymer material within at least one of the elements such that the materials of the elements are secured to each other when cooled. As examples, thermal bonding may involve (a) the melting or softening of two elements incorporating thermoplastic polymer materials such that the thermoplastic polymer materials intermingle with each other (e.g., diffuse across a boundary layer between the thermoplastic polymer materials) and are secured together when cooled; (b) the melting or softening of a first element incorporating a thermoplastic polymer material such that the thermoplastic polymer material extends into or infiltrates the structure of a second element to secure the elements together when cooled; and (c) the melting or softening of a first element incorporating a thermoplastic polymer material such that the thermoplastic polymer material extends into or infiltrates crevices or cavities formed in a second element to secure the elements together when cooled. As discussed above, therefore, thermal bonding may occur, therefore, when (a) both of flange 53 and the outer surface of bladder 40 include thermoplastic polymer materials or (b) only one of flange 53 and the outer surface of bladder 40 includes a thermoplastic polymer material. Although thermal bonding may be performed utilizing conduction as the manner in which heat is applied to the elements, thermal bonding also includes the use of radio frequency energy (i.e., radio-frequency bonding) and high frequency sound (i.e., sonic bonding), for example. Additionally, thermal bonding does not generally involve the use of adhesives, but involves directly bonding elements to each other with heat. In some situations, however, adhesives may be utilized to supplement the thermal bond joining flange 53 and bladder 40.

Figure 8:
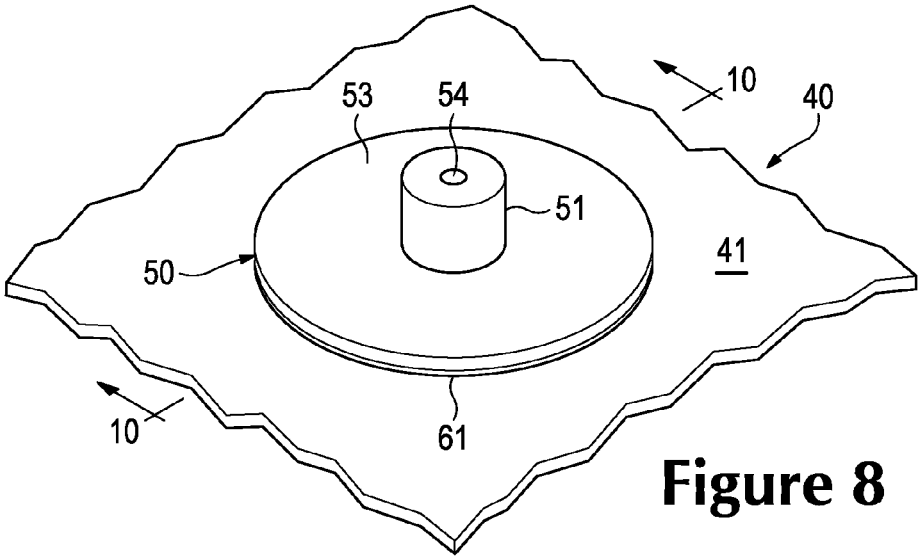
FIG. 8 is a perspective view of a second configuration of the portion of the bladder and the valve.
Figure 9:
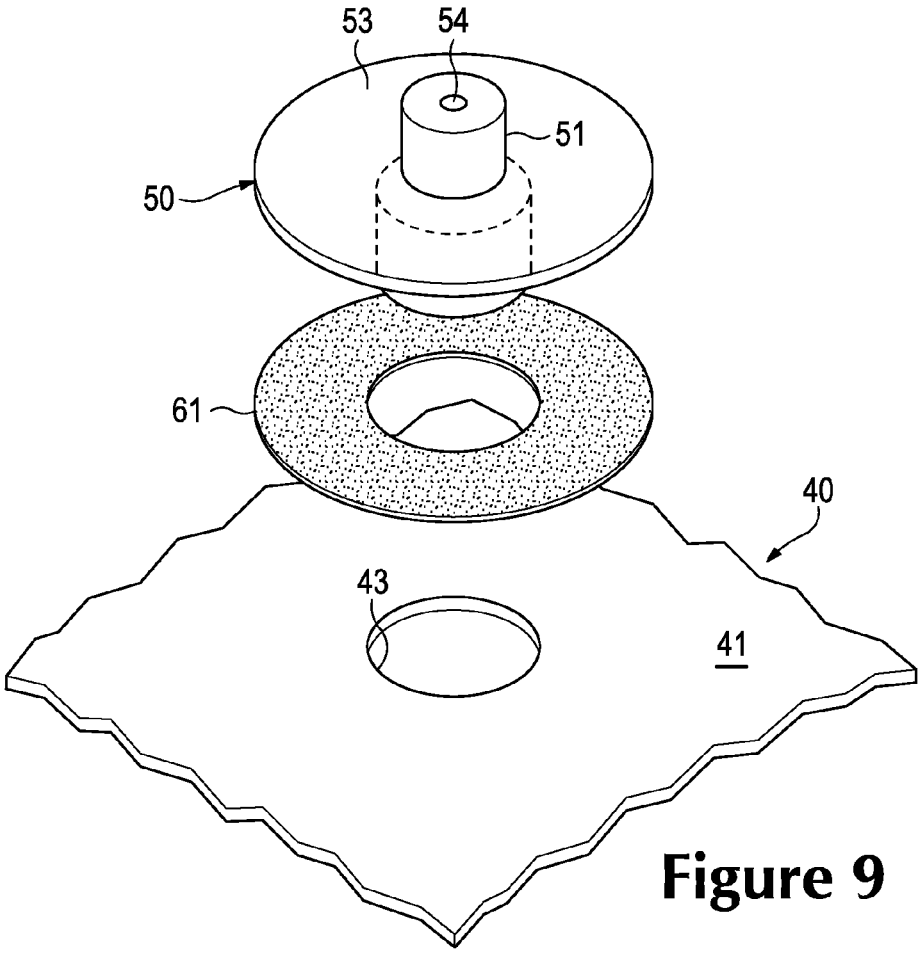
FIG. 9 is an exploded perspective view of the second configuration of the portion of the bladder and the valve.
Figure 10:
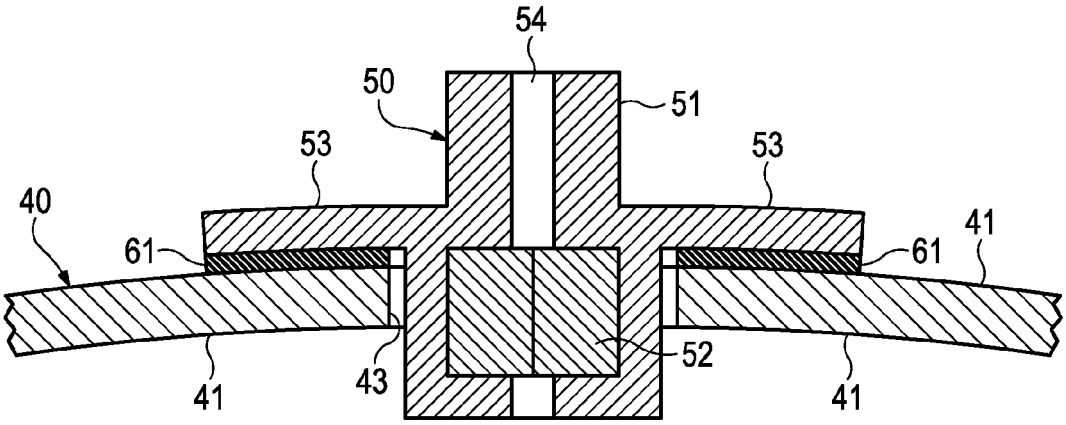
FIG. 10 is a cross-sectional view, as defined by section line 10 in FIG. 8, of the second configuration of the portion of the bladder and the valve.

An example of valve 50 being secured to bladder 40 with adhesive bonding is depicted in FIGS. 8-10. In this configuration, flange 53 lays parallel to the outer surface of bladder 40 and is joined to the outer surface of bladder 40 with an adhesive 61. Although flange 53 may be in contact with the outer surface of bladder 40 when joined through adhesive bonding, a thin layer of adhesive 61 may also separate flange 53 from the outer surface of bladder 40. In general, adhesive bonding may be utilized regardless of the materials forming flange 53 and the outer surface of bladder 40. The chemical composition of adhesive 61 should be selected, however, depending upon the particular materials forming flange 53 and the outer surface of bladder 40. That is, adhesive 61 should be selected to be capable of bonding with both flange 53 and the outer surface of bladder 40.

Figure 11:
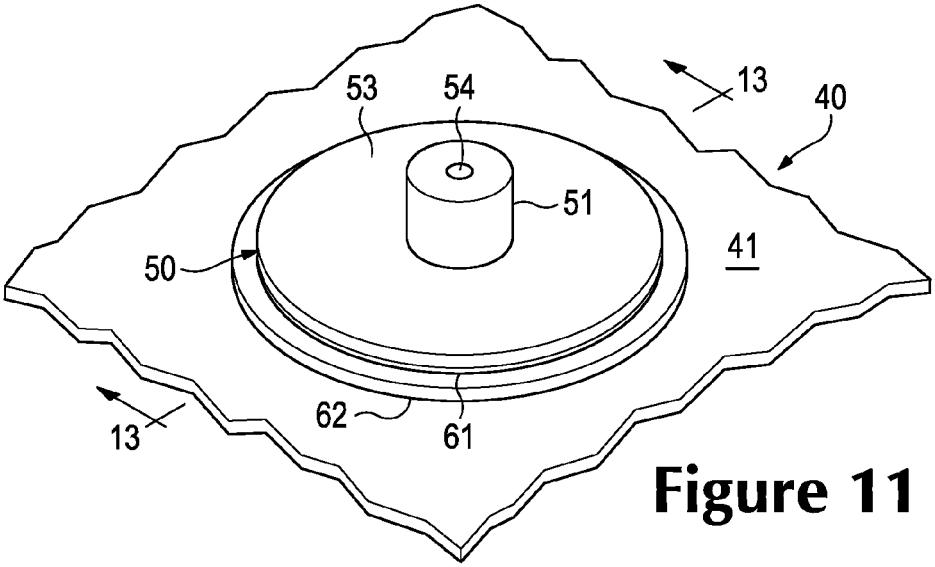
FIG. 11 is a perspective view of a third configuration of the portion of the bladder and the valve.
Figure 12:
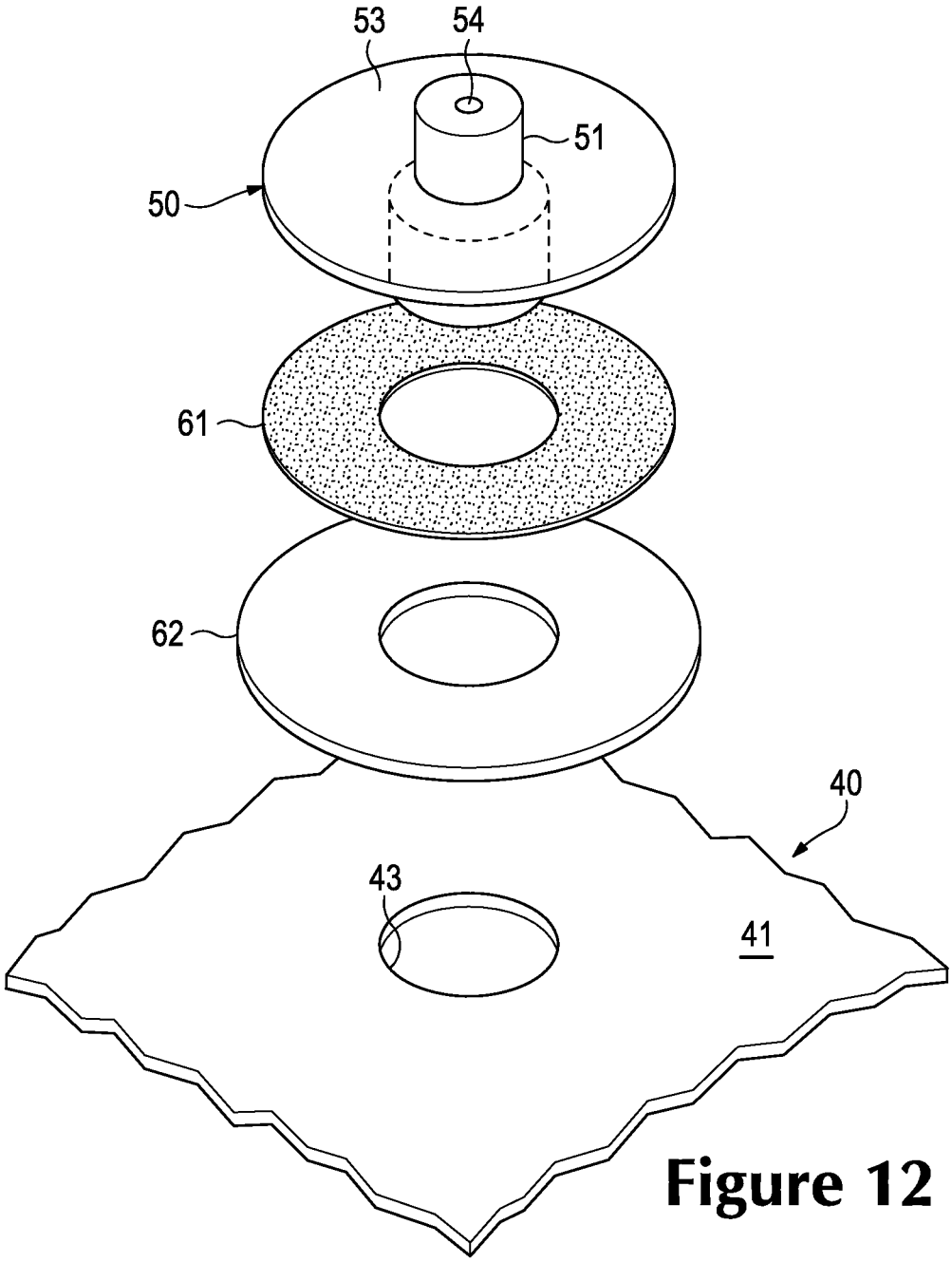
FIG. 12 is an exploded perspective view of the third configuration of the portion of the bladder and the valve.
Figure 13:
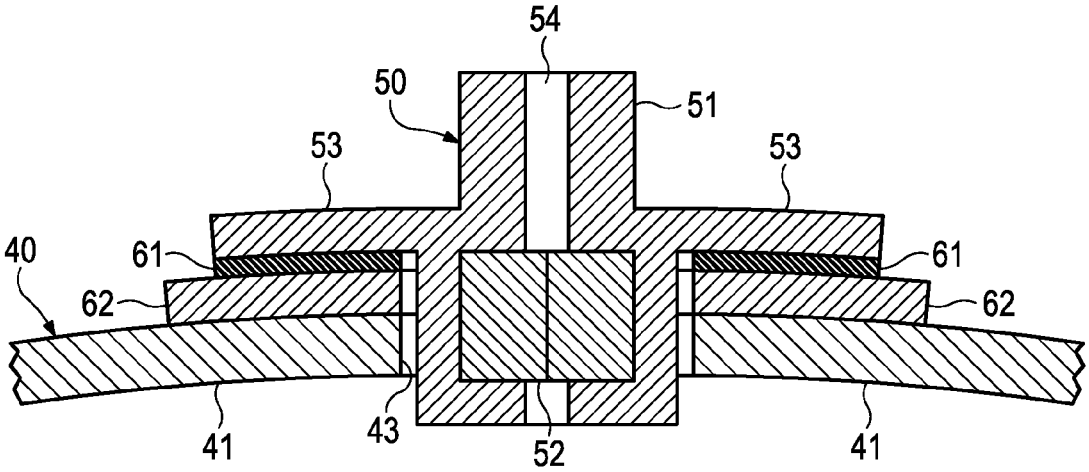
FIG. 13 is a cross-sectional view, as defined by section line 13 in FIG. 11, of the third configuration of the portion of the bladder and the valve.

Additionally, an example of valve 50 being secured to bladder 40 with a bonding element having the form of a tie layer 62 is depicted in FIGS. 11-13. In this configuration, flange 53 lays parallel to the outer surface of bladder 40 and is separated from the outer surface of bladder 40 by tie layer 62. That is, tie layer 62 is positioned between flange 53 and bladder 40. Although the structure of tie layer 62 may vary significantly, tie layer 62 is depicted as having a circular and ring-shaped configuration. Moreover, a diameter of tie layer 62 is depicted as being greater than a diameter of flange 53. In this configuration, an outer edge of tie layer 62 extends outward and beyond an outer edge of flange 53, as depicted in FIG. 11.

Tie layer 62 may be utilized, for example, when flange 53 is formed from vulcanized rubber and the outer surface of bladder 40 is formed from another polymer material. As depicted, tie layer 62 is joined to flange 53 through adhesive bonding (i.e., with adhesive 61), and tie layer 62 is joined to bladder 40 through thermal bonding. As such, tie layer 62 may be joined to each of valve 50 and bladder 40 through different bonding techniques.

The use of tie layer 62 provides various advantages to sport ball 10. For example, adhesive 61 may be utilized to initially bond tie layer 62 to flange 53. Subsequently, tie layer 62 may be joined to bladder 40 through thermal bonding. During some manufacturing processes, efficiency may be enhanced by bonding tie layer 62 to flange 53 in one location (e.g., at the location where valve 50 is manufactured) and then utilizing thermal bonding to join valve 50 to bladder 40 as another location (e.g., at the location where bladder 40 is manufactured). Another advantage of tie layer 62 is that it may be utilized to bond dissimilar materials in flange 53 and the outer surface of bladder 40. For example, flange 53 and the outer surface of bladder 40 may be formed from materials that do not readily bond through either of thermal bonding and adhesive bonding. The material of tie layer 62 may, however, be selected such that (a) adhesive bonding joins tie layer 62 to flange 53 and (b) thermal bonding joins tie layer 62 to bladder 40. That is, the material of tie layer may be selected to effectively join valve 50 and bladder 40.

Material Selection

Various factors may be considered when selecting materials for bladder 40. As an example, the engineering properties of the materials (e.g., tensile strength, stretch properties, fatigue characteristics, dynamic modulus, and loss tangent) may be considered. The ability of the materials to be shaped into bladder elements 41 and bonded to form seam 42 during the manufacture of bladder 40 may be considered. The ability of the materials to bond with valve 50 through any of the bonding techniques discussed above may also be considered. Additionally, the ability of the materials to prevent the transmission (e.g., diffusion, permeation) of the fluid contained by bladder 40 may be considered.

Suitable materials for bladder 40 include a variety of thermoset and thermoplastic polymer materials. An advantage of thermoplastic polymer materials is that they may be molded (e.g., thermoformed) to impart the shape of each bladder element 41. Moreover, thermoplastic polymer materials may be thermal bonded to each other to form seam 42. Examples of polymer materials that may be utilized for bladder 40 include any of the following: polyurethane, urethane, polyester, polyester polyurethane, polyether, polyether polyurethane, latex, polycaprolactone, polyoxypropylene, polycarbonate macroglycol, and mixtures thereof.

Figure 14A:
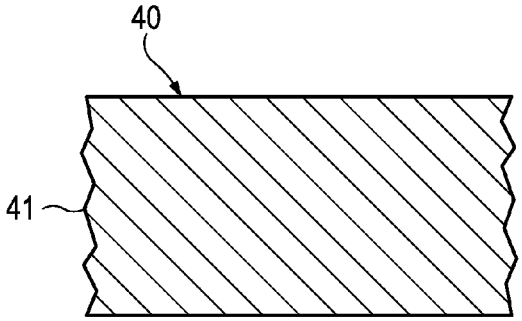
FIGS. 14A-14E are detailed cross-sectional views of the bladder, as defined in FIG. 7.
Figure 14B:
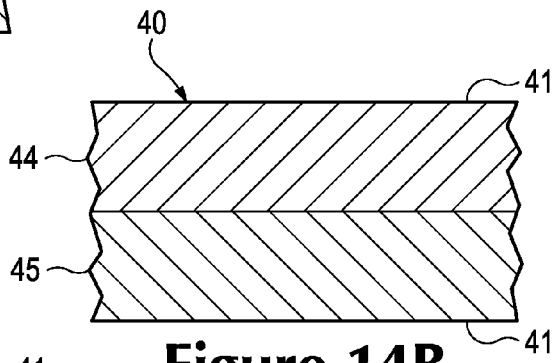
Figure 14C:
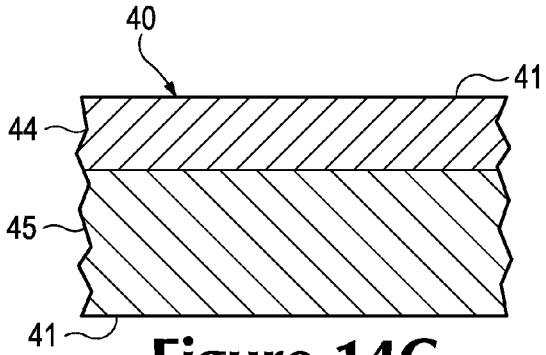
Figure 14D:
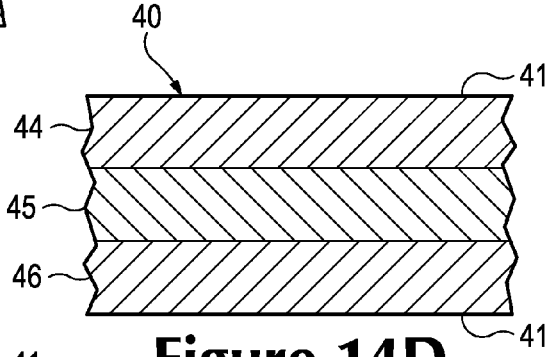

Any one of the materials noted above may form bladder 40. Referring to FIG. 14A, a cross-section through a portion of bladder 40 is depicted. In this configuration, a single material forms both surfaces of bladder 40 and extends uniformly between the surfaces. In effect, therefore, bladder 40 may be formed as a single layer of any suitable material. Another configuration is depicted in FIG. 14B, wherein bladder 40 includes a first layer 44 and a second layer 45. Whereas first layer 44 forms a portion of the outer surface of bladder 40, second layer 45 forms a portion of an inner surface of bladder 40. An advantage of the layered configuration is that the properties of the material forming first layer 44 and the properties of the material forming second layer 45 are effectively combined. For example, first layer 44 may be formed from a durable material that facilitates thermal bonding with valve 50, and second layer 45 may be formed from a barrier material that substantially prevents or reduces the transmission of the fluid contained by bladder 40. Although the relative thicknesses of layers 44 and 45 may be substantially equal, FIG. 14C depicts a configuration wherein second layer 45 exhibits greater thickness than first layer 44. As a further configuration, FIG. 14D depicts a layered structure that includes a third layer 46. In this configuration, all three of layers 44-46 may be formed from different materials with properties that are beneficial to bladder 40. Alternately, layers 44 and 46 may be formed from the same material, with second layer 45 being formed from a different material. Accordingly, the structure of the materials within bladder 40 may vary considerably.

In general, the fluid contained by bladder 40 will be air, which primarily includes molecules in the following proportions: 78 percent nitrogen, 21 percent oxygen, less than one percent argon and carbon dioxide, and small amounts of other gasses. Depending upon humidity levels, air also includes an average of about one percent water vapor. As such, selecting a material with the ability to substantially prevent the transmission of nitrogen or oxygen may be effective in limiting transmission of the fluid contained by bladder 40, thereby limiting changes in pressure within bladder 40. Other fluids that may be contained by bladder 40 include sulfur-hexafluoride and substantially pure nitrogen.

An example of a material that is effective in limiting transmission of is disclosed in U.S. Pat. Nos. 5,713,141 and 5,952,065 to Mitchell, et al., both of which are incorporated herein by reference. Although various configurations may be utilized, this material generally includes a first layer of thermoplastic polymer material and a second layer of barrier material. The thermoplastic polymer material provides the ability to form thermal bonds, as well as a suitable degree of tensile strength, tear strength, flexural fatigue strength, modulus of elasticity, and abrasion resistance. The barrier material is effective in limiting the transmission of the fluid within bladder 40 (e.g., nitrogen). In some configurations, the thermoplastic polymer material may be a thermoplastic urethane. Moreover, the thermoplastic urethane may be selected from a group including polyester, polyether, polycaprolactone, polyoxypropylene and polycarbonate macroglycol based materials, and mixtures thereof. In some configurations, the barrier material may be selected from a group including ethylene-vinyl alcohol copolymer, polyvinylidene chloride, co-polymers of acrylonitrile and methyl acrylate, polyesters such as polyethyleneterephthalate, aliphatic and aromatic polyamides, liquid crystal polymers, and polyurethane engineering thermoplastics. In the configuration of FIG. 14B, for example, the thermoplastic urethane may form first layer 44 and the barrier material (e.g., ethylene-vinyl alcohol copolymer) may form second layer 45. As another example, which relates the configuration of FIG. 14D, the thermoplastic urethane may form layers 44 and 46 and the barrier material (e.g., ethylene-vinyl alcohol copolymer) may form second layer 45. In some configurations, bladder 40 may be formed from other layered materials, including a material disclosed in U.S. Pat. Nos. 6,082,025 and 6,127,026 to Bonk, et al., both of which are incorporated herein by reference.

Figure 14E:
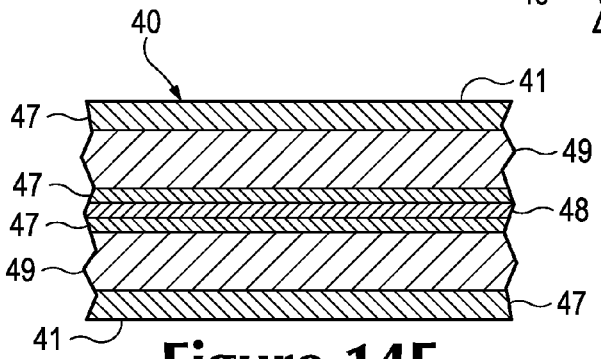

Another example of a material that is effective in limiting the transmission of fluid (e.g., nitrogen) is depicted in FIG. 14E. This material includes a multi-layered configuration that has four layers 47, one layer 48, and two layers 49. Layers 47 may be a thermoplastic urethane, including any selected from a group including polyester, polyether, polycaprolactone, polyoxypropylene and polycarbonate macroglycol based materials, and mixtures thereof. Layer 48 may be ethylene-vinyl alcohol copolymer. Additionally, layer 49 may be a regrind or mixture of thermoplastic urethane and ethylene-vinyl alcohol copolymer, potentially from recycled portions of this material. Note that a central portion of this material includes two layers 47 formed from thermoplastic urethane located on opposite sides of one layer 48 formed from ethylene-vinyl alcohol copolymer.

Testing conducted on the material of FIG. 14E demonstrated increased inflation-retention properties over other materials that are commonly utilized for sport ball bladders. More particularly, the tests indicated that a rubber basketball bladder transmits oxygen at a rate that is approximately 47 times the rate of the material of FIG. 14E. Similarly, the tests indicated that a thermoplastic urethane football bladder transmits oxygen at a rate that is approximately 361 times the rate of the material of FIG. 14E. Additionally, both rubber and thermoplastic urethane transmit nitrogen at a greater rate than the material of FIG. 14E. Accordingly, the material of FIG. 14E, which includes ethylene-vinyl alcohol copolymer as a barrier, shows less oxygen and nitrogen transmission than other materials that are commonly utilized for sport ball bladders. In effect, therefore, the material of FIG. 14E and other materials noted above may be utilized to provide an inflation-retention bladder.

Further examples of materials that are suitable for bladder 40 include a flexible microlayer membrane that has alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and 6,321,465 to Bonk, et al.

As with bladder 40, a variety of materials may be utilized for valve 50. Valve housing 51 may be formed from various thermoset polymer materials (e.g., vulcanized rubber) or various thermoplastic polymer materials (e.g., thermoplastic polyurethane and thermoplastic elastomer). Depending upon the specific application in which valve 50 is intended to be used, advantages may be gained by forming valve housing 51 from either thermoset or thermoplastic polymer materials. Valve housing 51 may be subjected to heat in some manufacturing methods for sport balls, including manufacturing processes that include vulcanization. Given that thermoset polymer materials may be more thermally-stable than thermoplastic polymer materials, these materials may be utilized in applications where valve 50 is exposed to relatively high temperatures. In sport balls manufacturing where relatively low or moderate temperatures are present, valve housing 51 may be formed from thermoplastic polymer materials to take advantage of thermal bonding as a means of securing valve 50 to bladder 40. Furthermore, valve insert 52 may also be formed from various materials, with examples being rubber and silicone.

Manufacturing Process for First Sport Ball

Sport ball 10 may be manufactured through a variety of processes. With regard to casing 20, the various casing panels 21 may be joined through stitching, adhesive bonding, or thermal bonding. Traditionally, soccer ball casing panels were joined through stitching, and this process is well known. Examples of processes utilizing thermal bonding to join casing panels of a sport ball are disclosed in U.S. Patent Application Publication 2009/0325744 to Raynak, et al. and U.S. Patent Application Publication 2010/0240479 to Raynak, et al.

Bladder 40 may be formed through a variety of methods. As discussed above, bladder elements 41 may be polymer elements that are thermoformed, molded, or otherwise manufactured to exhibit a rounded or hemispherical configuration. Once molded, bladder elements 41 are joined at seam 42. This general process is disclosed in U.S. Patent Application Publication 2009/0325745 to Rapaport, et al., which is incorporated herein by reference. Valve 50 may be joined to bladder 40 at various stages of the manufacturing process through adhesive bonding, thermal bonding, or a bonding element. For example, valve 50 may be joined (a) to the polymer sheets prior to thermoforming, (b) to bladder elements 41 prior to the formation of seam 42, or (c) to bladder 40 following the formation of seam 42. As an alternative, bladder elements 41 may be planar polymer elements that are joined at seam 42 and then pressurized to cause expansion and induce bladder 40 to take on the generally spherical shape.

Following the formation of bladder 40 and the joining of valve 50, restriction structure 30 may be placed around bladder 40. As discussed above, restriction structure 30 may be formed from (a) a thread, yarn, or filament that is repeatedly wound around bladder 40 in various directions to form a mesh that covers substantially all of bladder 40, (b) a plurality of generally flat or planar textile elements stitched together to form a structure that extends around bladder 40, (c) a plurality of generally flat or planar textile strips that are impregnated with latex and placed in an overlapping configuration around bladder 40, or (d) a substantially seamless spherically-shaped textile. The combination of restriction structure 30 and bladder 40 are then located within casing 20 to substantially complete the manufacturing of sport ball 10.

An additional consideration relating the manufacturing process for sport ball 10 pertains to valve 50. As discussed above, valve 50 may be formed from various thermoset polymer materials (e.g., vulcanized rubber) or various thermoplastic polymer materials (e.g., thermoplastic polyurethane and thermoplastic elastomer). The manufacturing process discussed above for sport ball 10 generally involves relatively low or moderate temperatures. As such, valve 50 may be formed from thermoplastic polymer materials to take advantage of thermal bonding as a means of securing valve 50 to bladder 40. Despite the relatively low or moderate temperatures, however, various thermoset polymer materials may be utilized for valve 50.

Second Sport Ball Configuration

Figure 15:
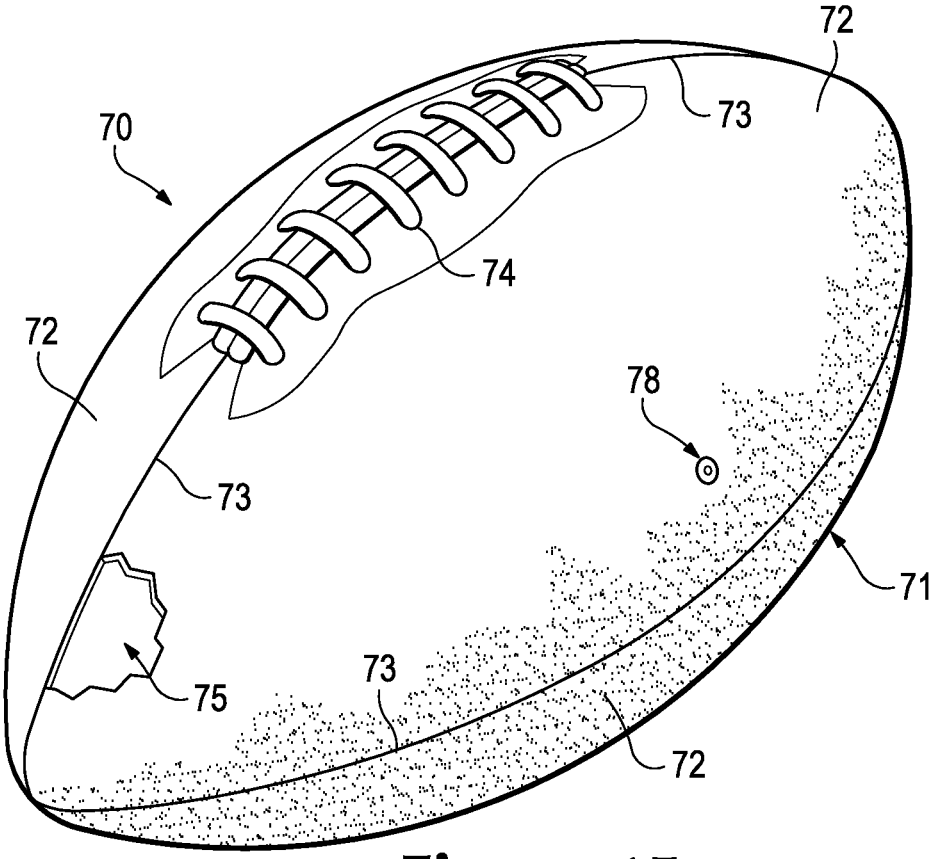
FIG. 15 is a perspective view of a second sport ball.
Figure 16:
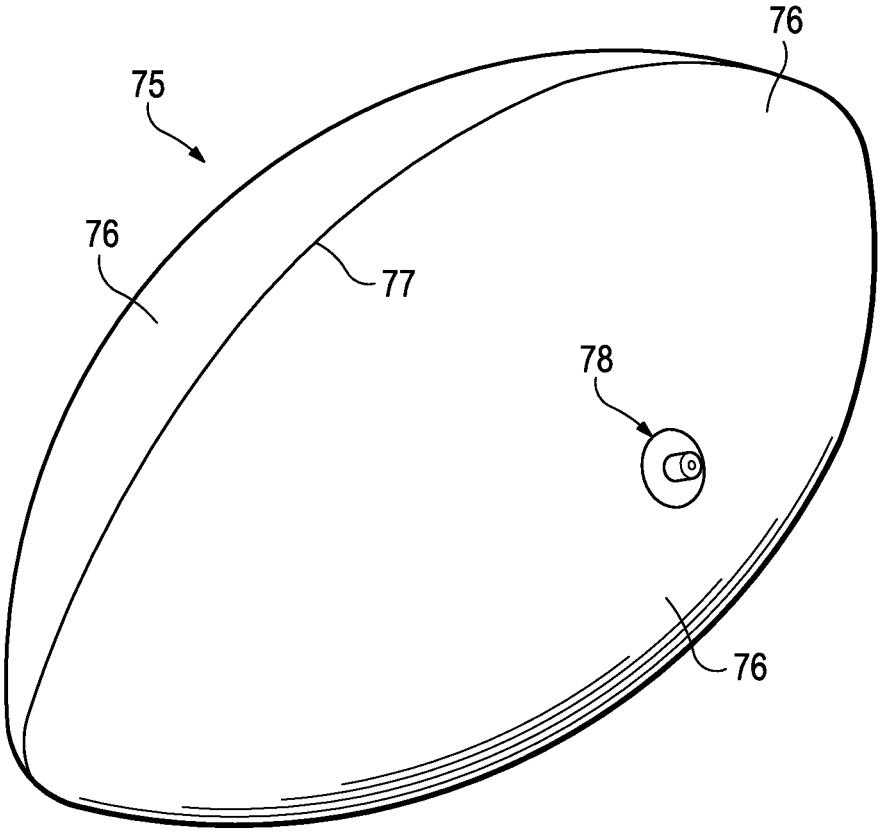
FIG. 16 is a perspective view of a bladder of the second sport ball.

Although sport ball 10 may have the configuration of a soccer ball, concepts associated with sport ball 10 may be incorporated into other types of sport balls. Referring to FIG. 15, a sport ball 70 is depicted as having the configuration of a football. A casing 71 forms an exterior of sport ball 70 and is formed from various panels 72 that are joined by seams 73. Laces 74 also extend along one of seams 73. A bladder 75, which is depicted individually in FIG. 16, is located within casing 71 and formed from various bladder elements 76 that are joined at seams 77. Whereas sport ball 10 and bladder 40 each have generally spherical shapes, sport ball 70 and bladder 75 each have an oblong shape that is characteristic of a football. Additionally, sport ball 70 includes a valve 78.

Bladder 75 and valve 78 incorporate many of the features discussed above for bladder 40 and valve 50. As such, bladder 75 may be formed from a material that includes a first layer of thermoplastic polymer material and a second layer of ethylene-vinyl alcohol copolymer, for example. Additionally, valve 78 may be secured to bladder 75 through adhesive bonding, thermal bonding, or a bonding element. In some configurations, valve 78 may be formed form thermoset polymer materials (e.g., vulcanized rubber) or various thermoplastic polymer materials (e.g., thermoplastic polyurethane and thermoplastic elastomer). Accordingly, sport ball 70 exhibits many of the features discussed above for sport ball 10, with the primary difference being shape. Similarly, other types of sport balls that include a casing and bladder may also incorporate these features including footballs for rugby and volleyballs, for example. It should also be noted that the general manufacturing process discussed above for sport ball 10 may also be utilized for sport ball 70.

Third Sport Ball Configuration

Figure 17:
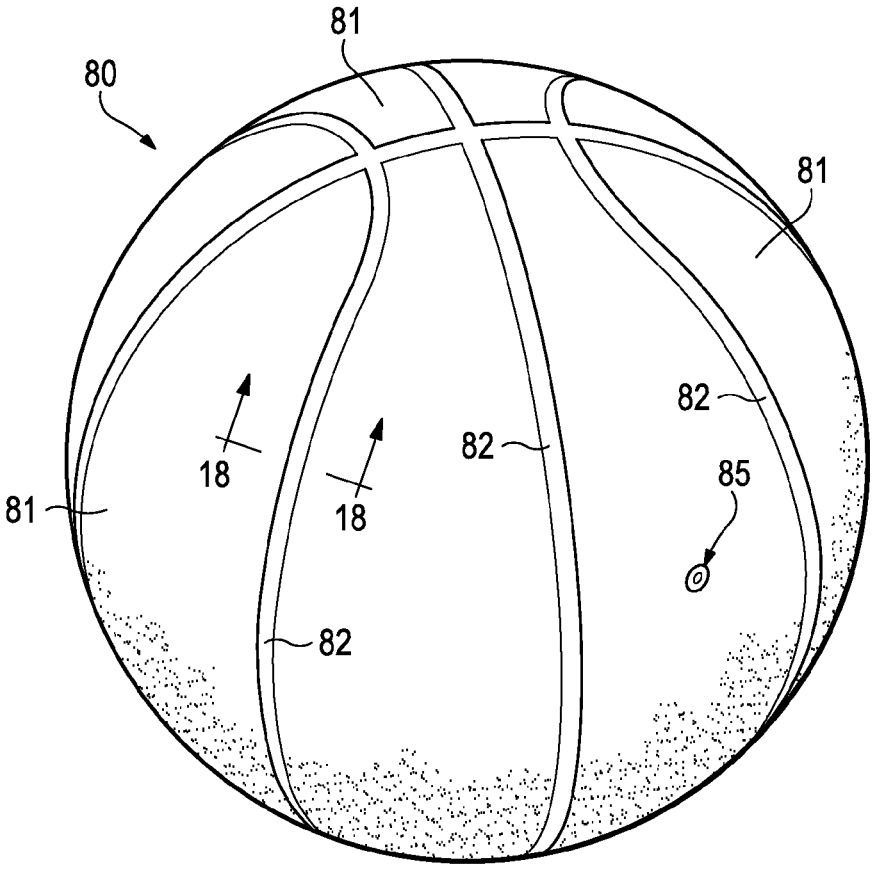
FIG. 17 is a perspective view of a third sport ball.
Figure 18:
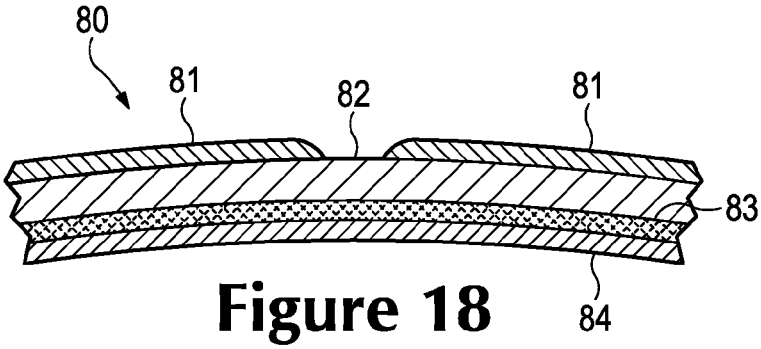
FIG. 18 is a cross-sectional view of a portion of the third sport ball, as defined by section line 18 in FIG. 17.

Another sport ball 80 is depicted in FIGS. 17 and 18 as having the configuration of a basketball. Sport ball 80 has a layered configuration that includes various panels 81, a carcass layer 82, a winding layer 83, and a bladder 84. In addition, sport ball 80 includes a valve 85. Panels 81 are separate elements that are bonded to an exterior of carcass layer 82. Although eight panels 81 are depicted, other number of panels 81 may be utilized. Each of panels 81 are spaced from adjacent panels 81 to form gaps or spaces that expose portions of carcass layers 82. As such, both panels 81 and carcass layer 82 form portions of an exterior surface of sport ball 80. Winding layer 83 is located inward of carcass layer 82 and is formed from a string, thread, yarn, or filament that is repeatedly wound around bladder 84, which forms an inner portion of sport ball 80. As an alternative or in addition to winding layer 83, any of the restriction structures noted for sport ball 10 may be utilized. Bladder 84 and valve 85 incorporate many of the features discussed above for bladder 40 and valve 50. As an example, therefore, bladder 84 may be formed from a material that includes a first layer of thermoplastic polymer material and a second layer of ethylene-vinyl alcohol copolymer, for example. Moreover, differences between sport ball 80 and sport balls 10 and 70, which are discussed in the manufacturing process below, demonstrate that the features discussed above for bladder 40 may be incorporated into various sport ball types.

Figure 19:
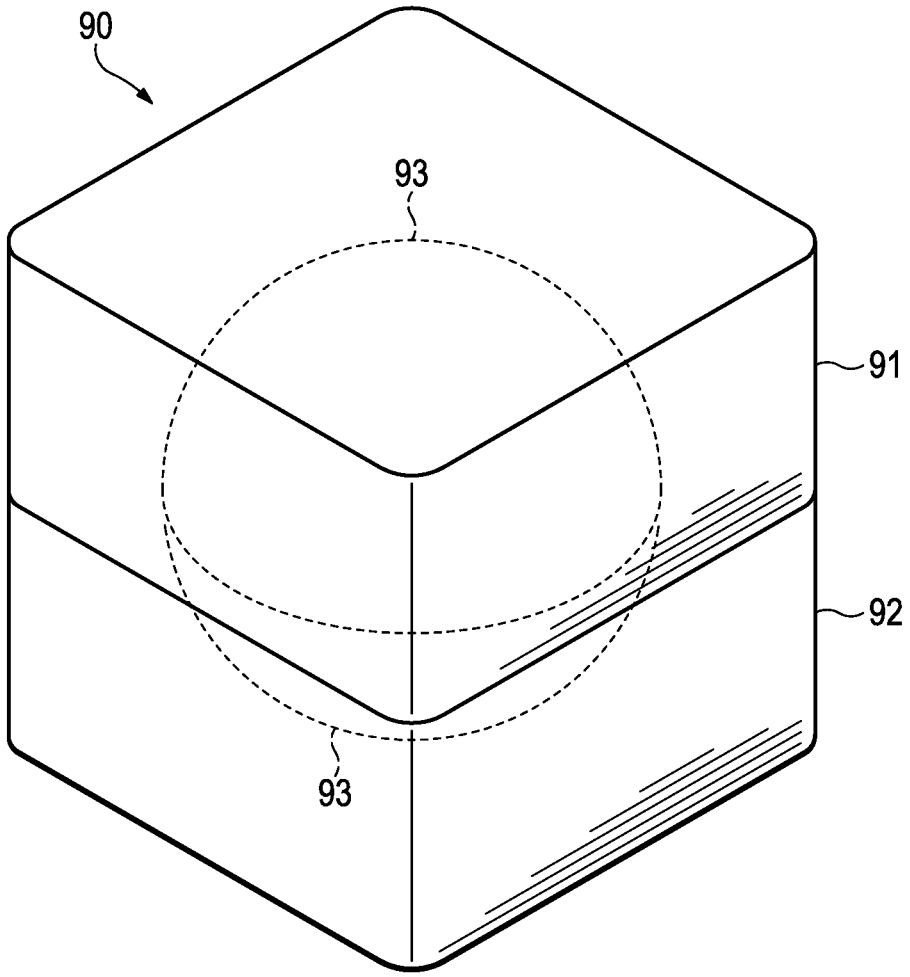
FIG. 19 is a perspective view of a mold utilized in manufacturing the third sport ball.
Figure 20:
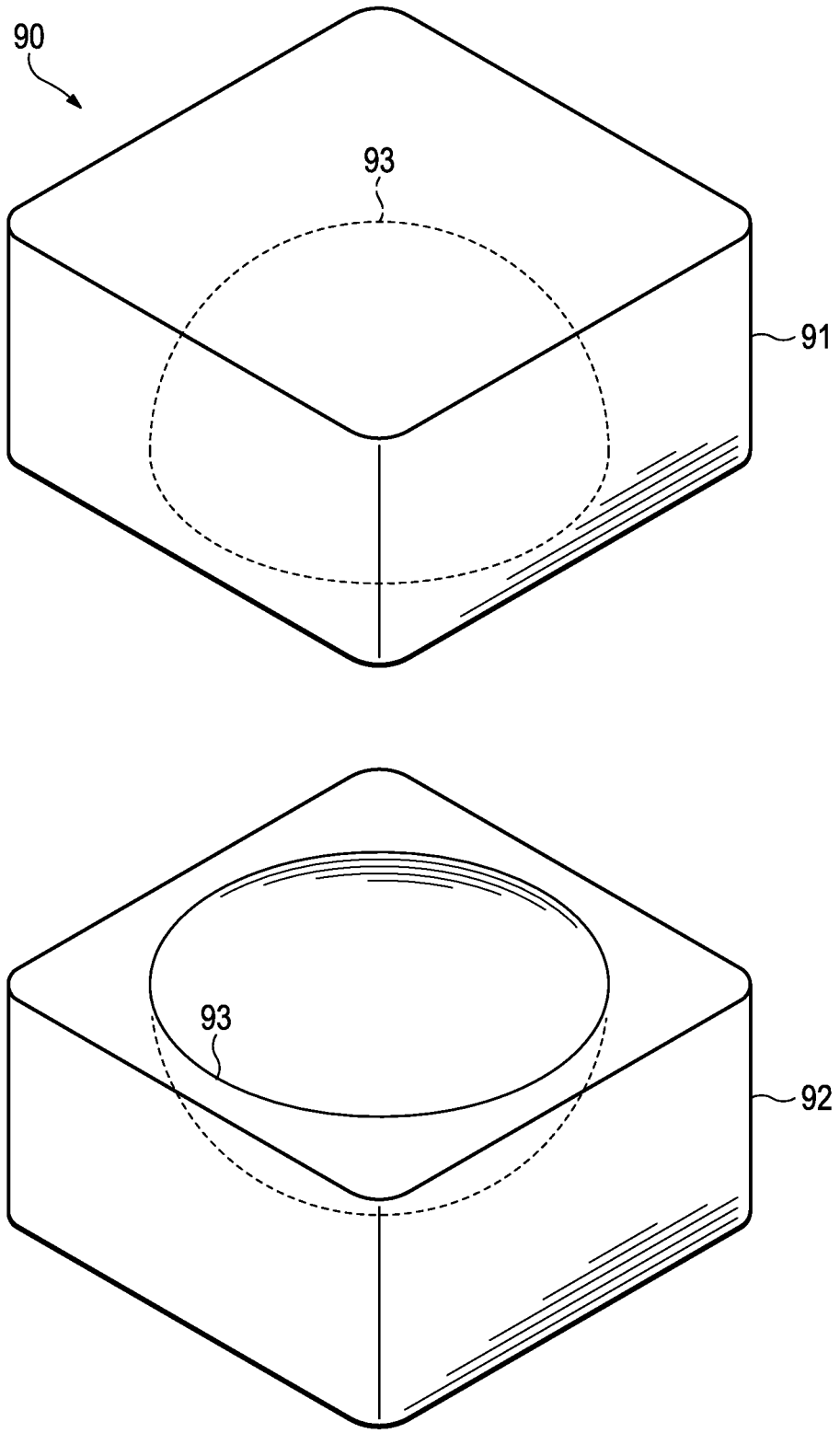
FIG. 20 is an exploded perspective view of the mold.

A mold 90, which is depicted in FIGS. 19 and 20, may be utilized in the manufacturing process for forming sport ball 80. Mold 90 has an upper mold portion 91 and a lower mold portion 92. Each of mold portions 91 and 92 have a hemispherical depression 93 with a diameter of carcass layer 82. When mold portions 91 and 92 are joined together, therefore, depressions 93 form a generally spherical void having the dimensions of carcass layer 82. Mold 90 incorporates a heating system (not depicted) that may be a series of electrical resistance heating elements embedded within each of mold portions 91 and 92. The heating system may also be a plurality of conduits that pass through mold portions 91 and 92 to channel a heated fluid.

Figure 21A:
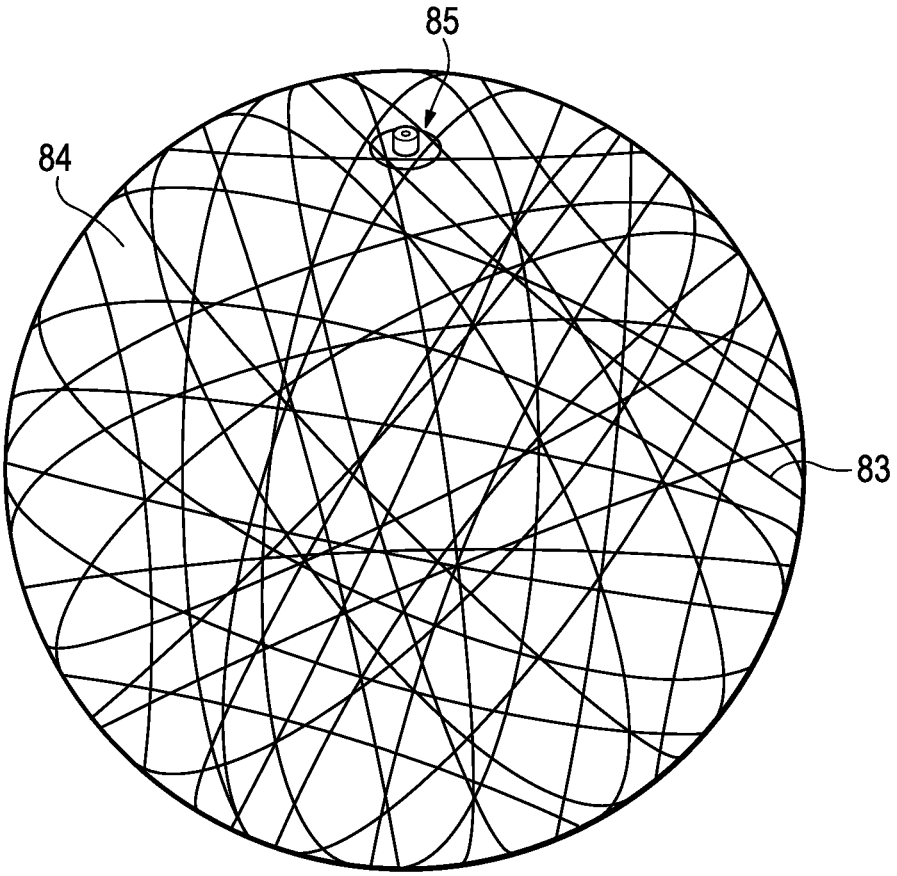
FIGS. 21A-21F are schematic perspective views of a manufacturing process for forming the third sport ball.
Figure 21B:
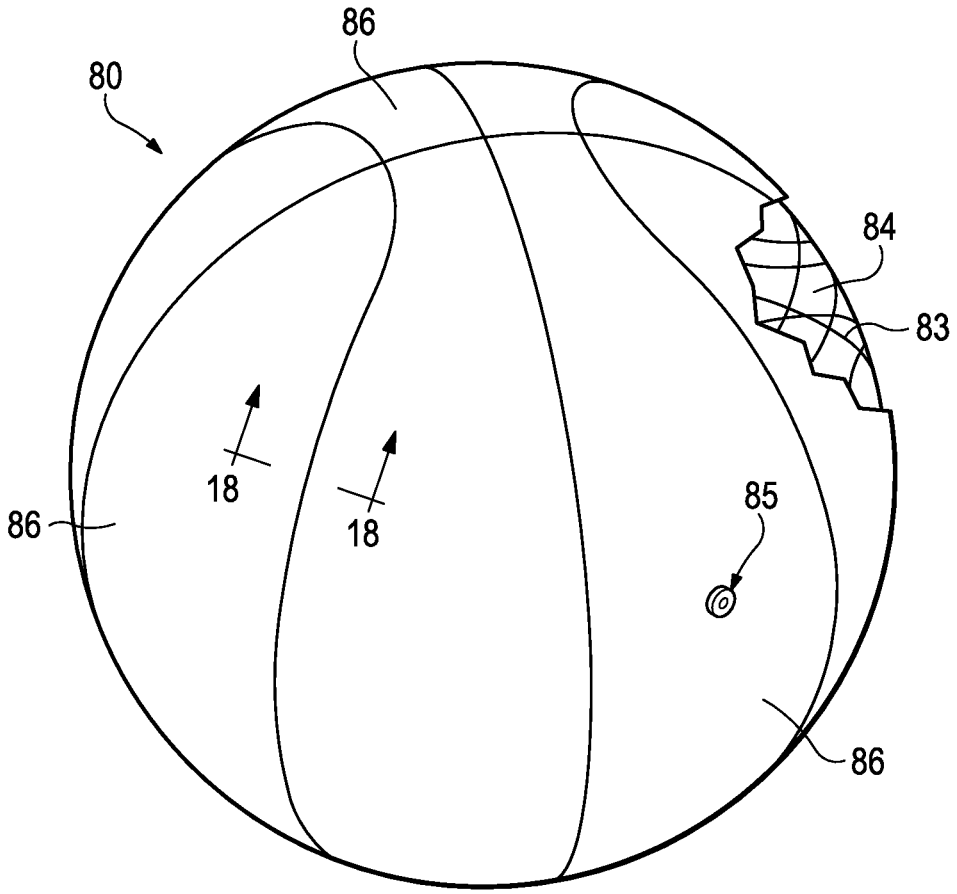
Figure 21C:
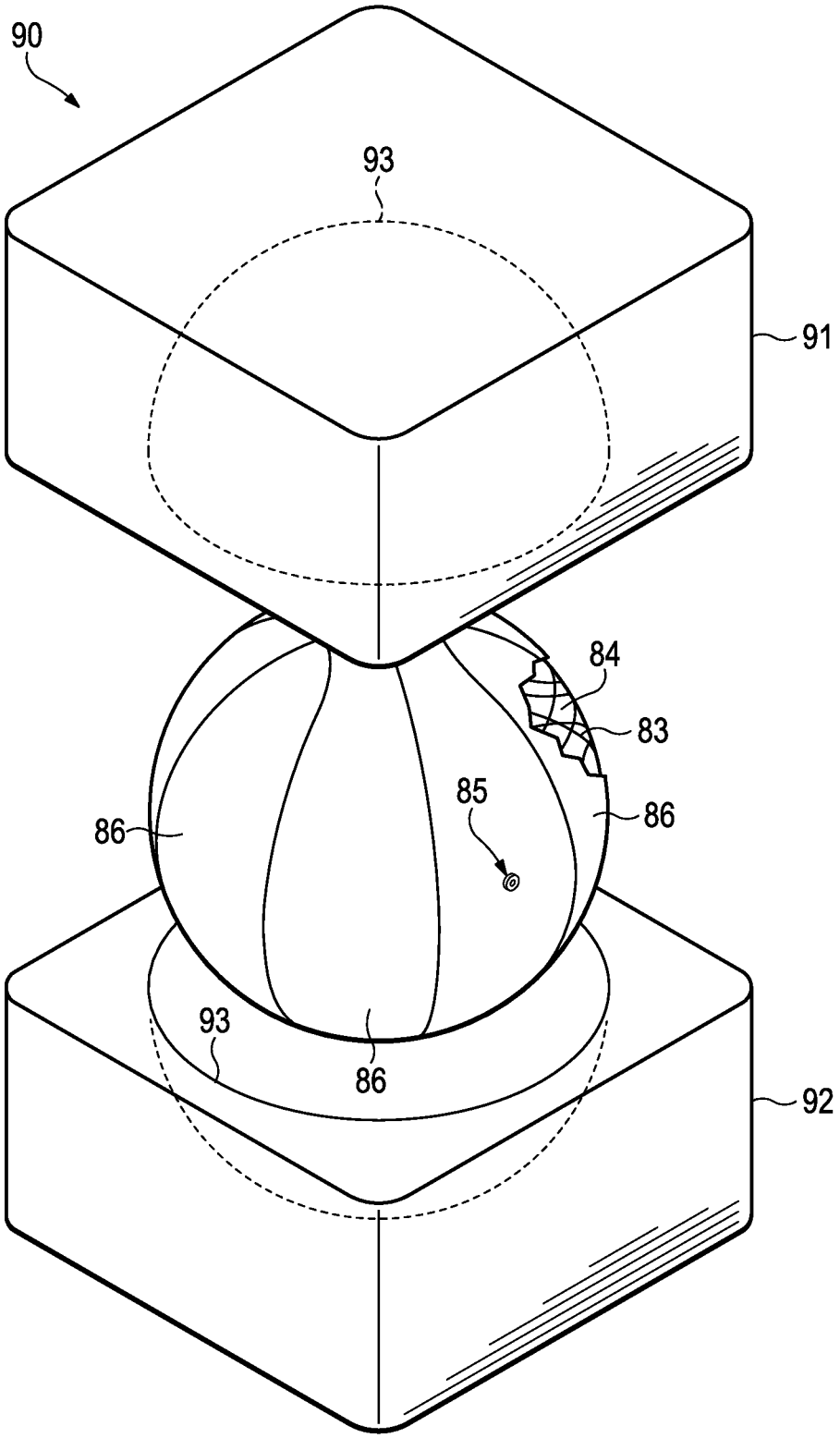
Figure 21D:
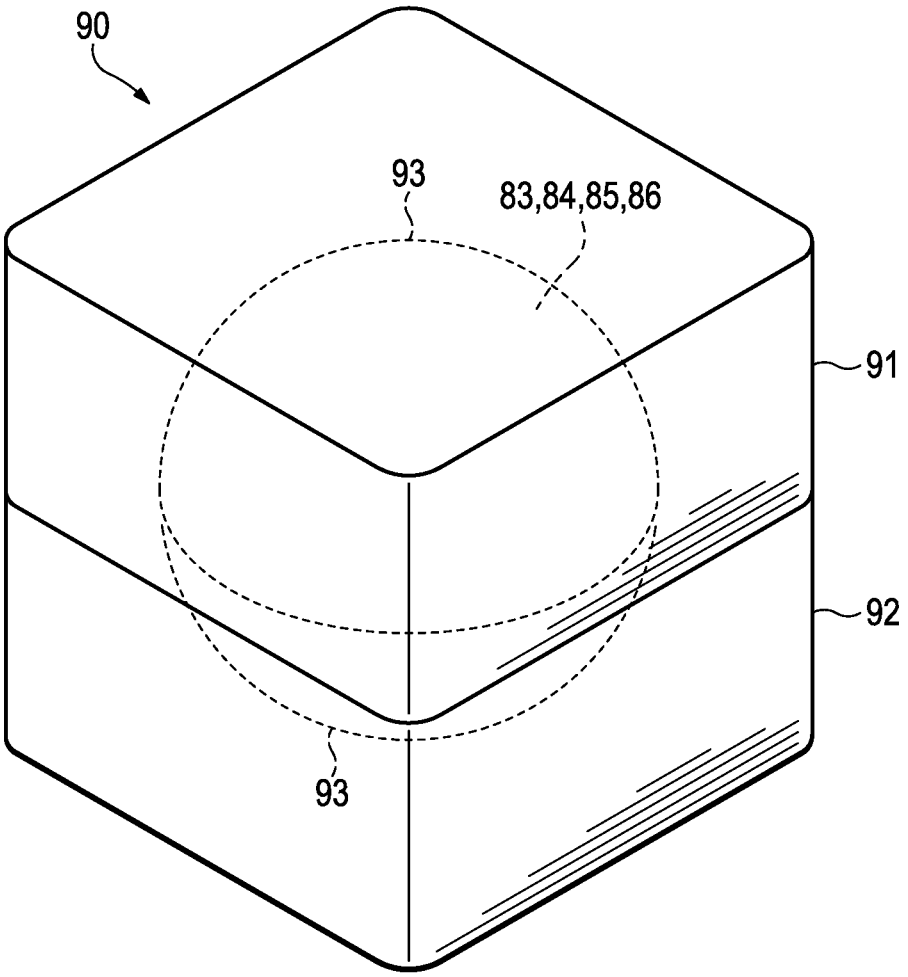

The manner in which mold 90 is utilized to form sport ball 80 will now be discussed. Initially, bladder 84 is formed according to the general principles noted above for bladder 40. Additionally, valve 85 is secured to bladder 84. Although thermal bonding or adhesive bonding are suitable, a bonding element similar to tie layer 62 may also be utilized. Bladder 84 is then inflated to a volume or diameter that corresponds with a resulting volume or diameter of bladder 84 within sport ball 80. Once inflated, a string, thread, yarn, or filament is repeatedly wound around bladder 84 to form winding layer 83, as depicted in FIG. 21A. Once winding layer 83 is complete, various non-vulcanized rubber elements 86 are located around the combination of winding layer 83, bladder 84, and valve 85, as depicted in FIG. 21B. The combination of winding layer 83, bladder 84, valve 85, and rubber elements 86 are then placed between mold portions 91 and 92, as depicted in FIG. 21C, and mold portions 91 and 92 close around the components, as depicted in FIG. 21D.

Figure 21E:
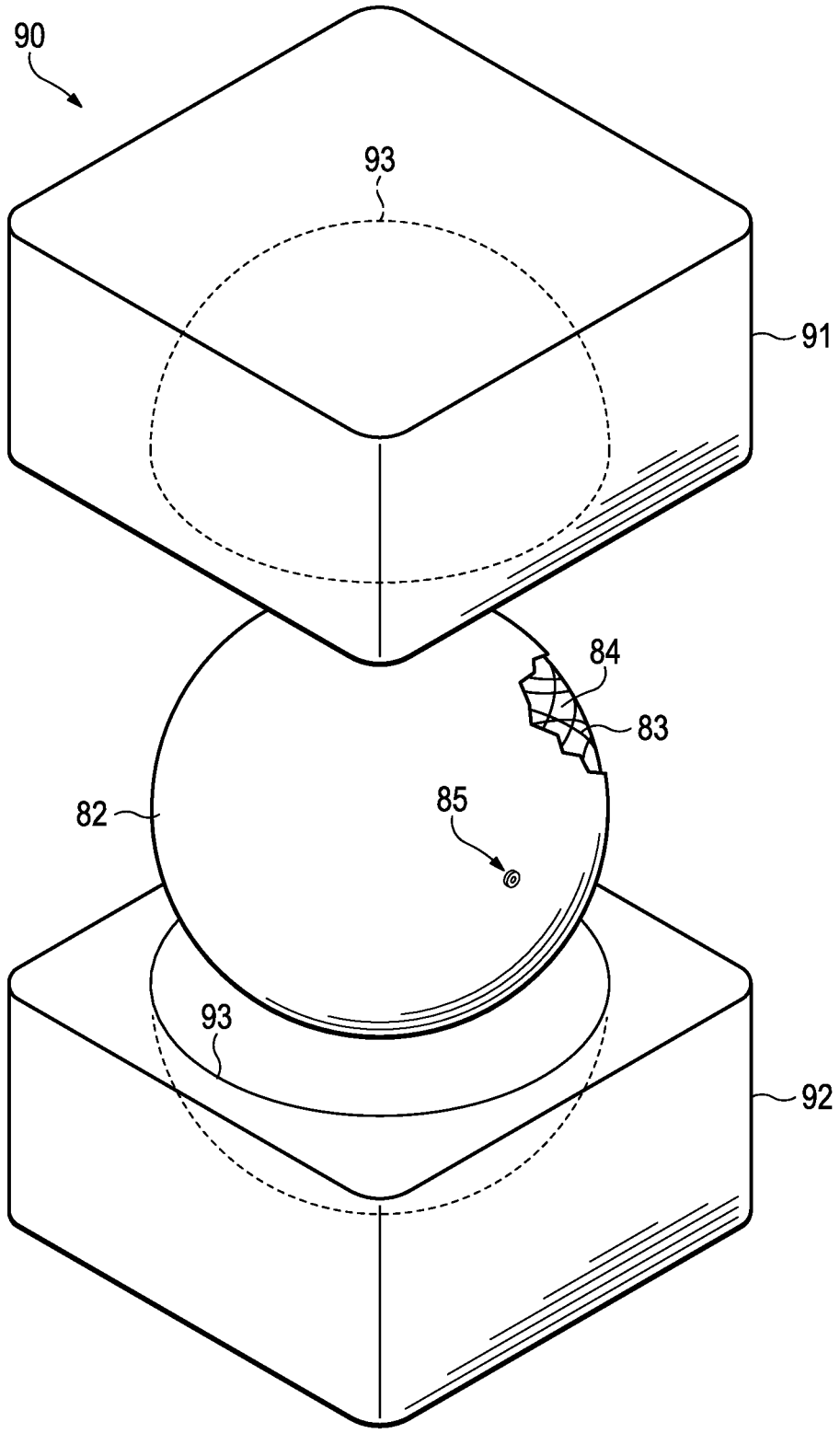
Figure 21F:
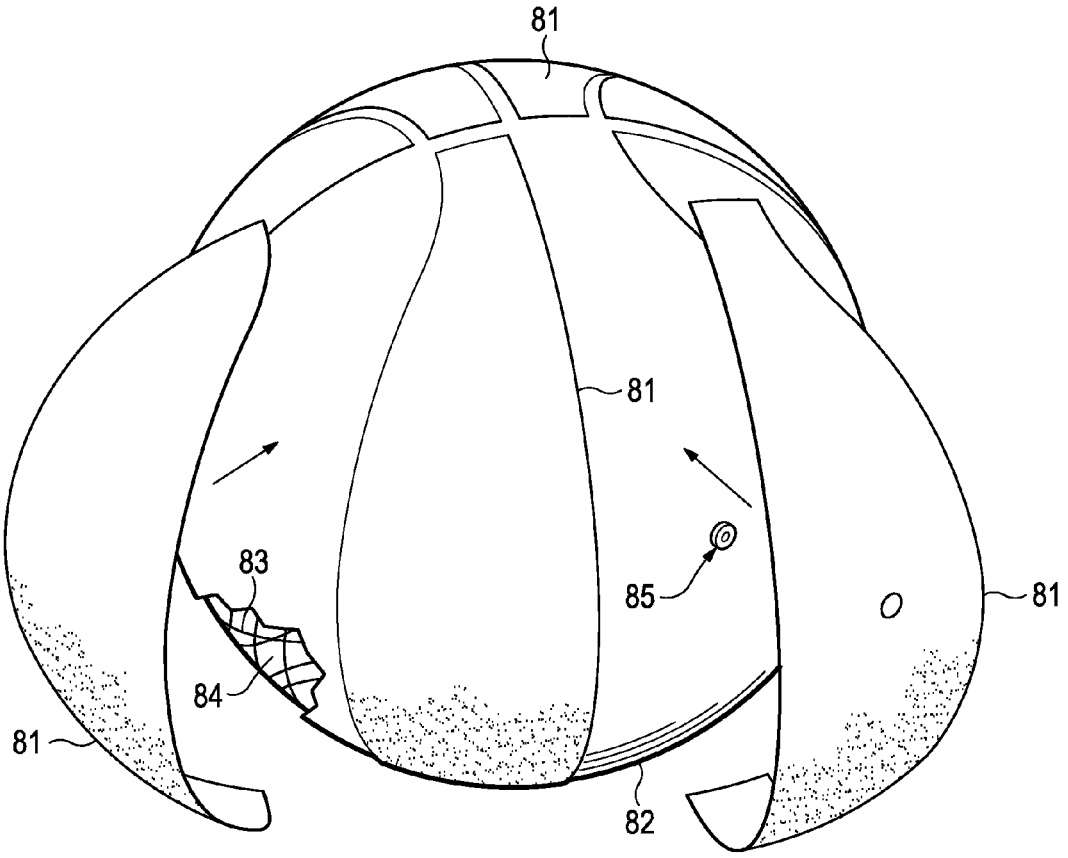

At this stage of the manufacturing process, mold 90 is heated to vulcanize rubber elements 86 and form carcass layer 82 from rubber elements 86. In effect, the vulcanization process melts rubber elements 86 and forms cross-links within the chemical structure of rubber elements 86 to form a vulcanized rubber shell (i.e., carcass layer 82) surrounding winding layer 83, bladder 84, valve 85. Once the vulcanization process is complete, mold 90 opens and the combination of carcass layer 82, winding layer 83, bladder 84, and valve 85 is removed, as depicted in FIG. 21E. Panels 81 are then secured to an exterior surface of carcass layer 82, as depicted in FIG. 21F, to substantially complete the manufacturing of sport ball 80.

In sport ball 10, for example, casing 20 is formed through various stitching or bonding processes that join casing panels 21. Restriction structure 30 and bladder 40 are then inserted within casing 20. In contrast, sport ball 80 is formed through a the molding process discussed above, where carcass layer 82, winding layer 83, bladder 84, and valve 85 are subjected to relatively high temperatures. More particularly, these elements are subjected to temperatures that are sufficient to vulcanize a rubber material in carcass layer 82. Given the relatively high temperatures that elements of sport ball 80 are subjected to during manufacturing, advantages are gained by forming valve 85 (or at least a valve housing of valve 85) from a thermoset polymer material (e.g., rubber). More particularly, thermoset polymer materials may be relatively thermally-stable, so these materials may be utilized in applications where valve 85 is exposed to higher temperatures. Although valve 85 may be formed from a thermoset polymer material, bladder 84 may incorporate thermoplastic polymer materials, as well as barrier materials, that impart inflation-retention properties to sport ball 80.

Figure 22:
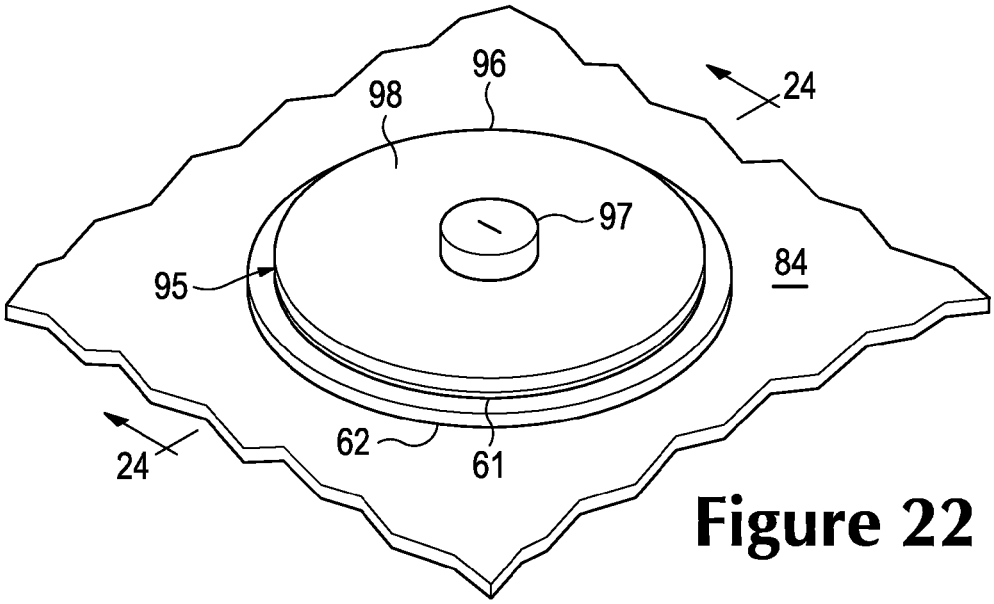
FIG. 22 is a perspective view of a portion of a bladder from the third sport ball and a valve.
Figure 23:
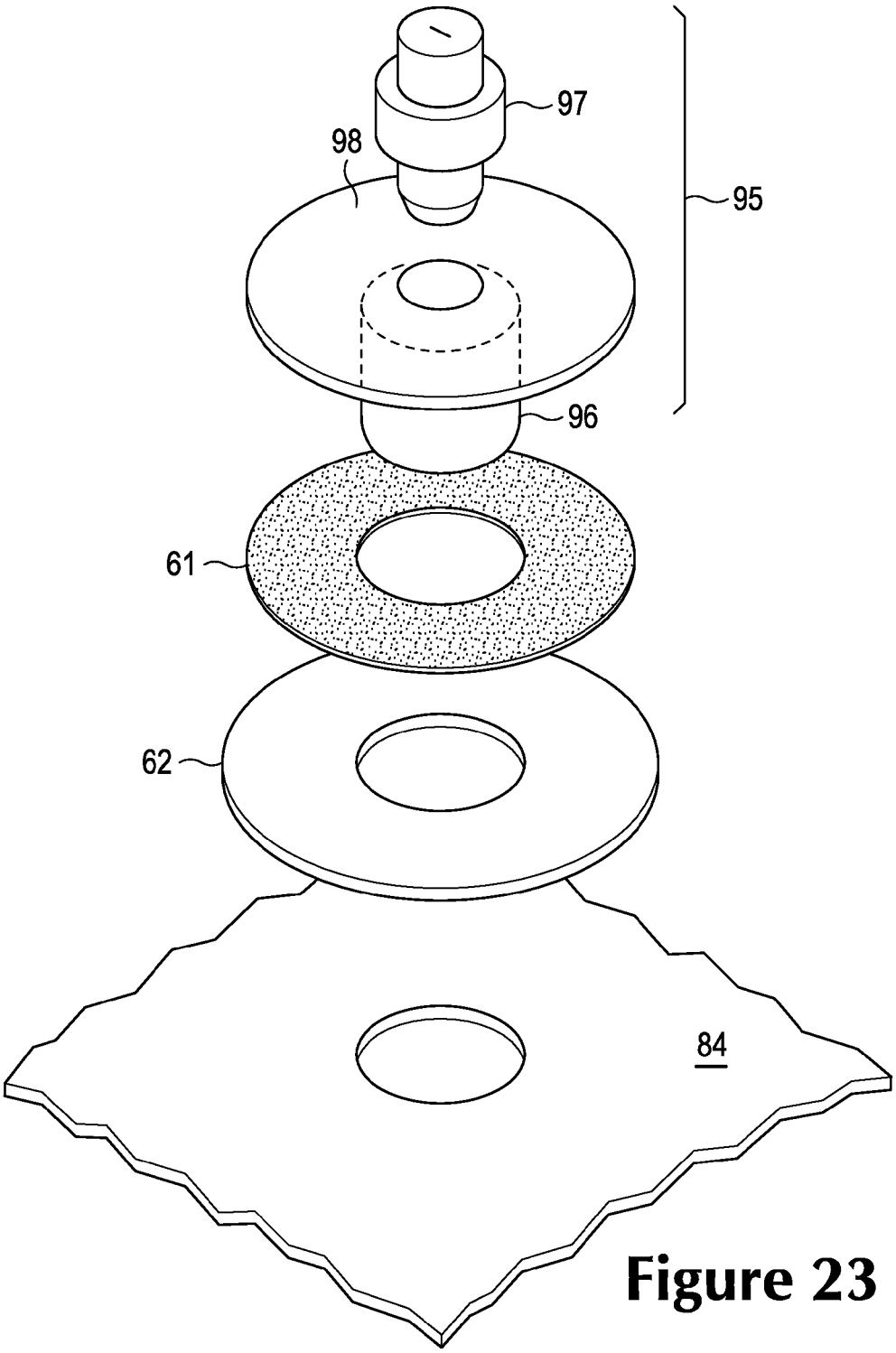
FIG. 23 is an exploded perspective view of the portion of the bladder from the third sport ball and the valve.
Figure 24:
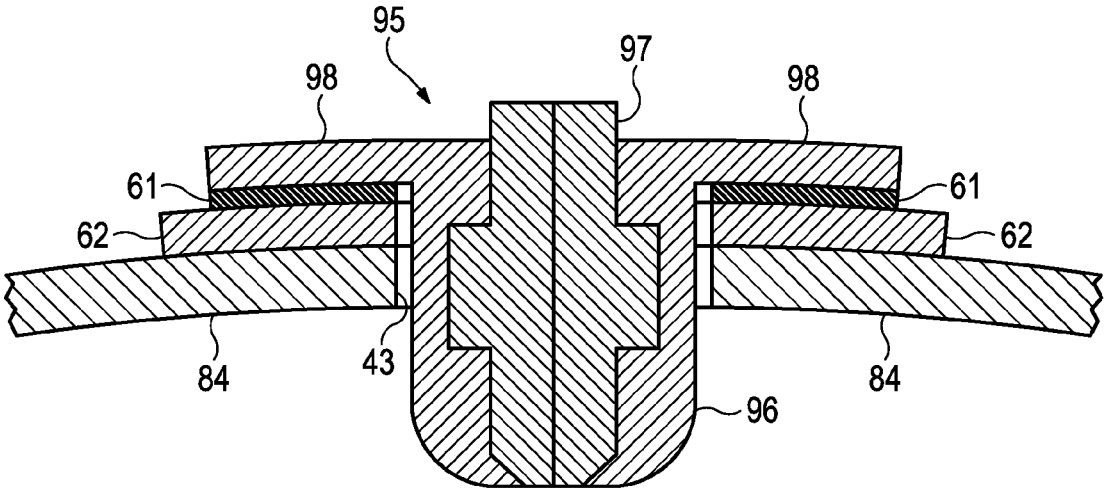
FIG. 24 is a cross-sectional view, as defined by section line 24 in FIG. 22, of the portion of the bladder from the third sport ball and the valve.

The configuration of valve 85 is depicted as being similar to valve 50 from sport ball 10. Valve 85 is intended to provide an example of one possible valve configuration that may be utilized in sport ball 80 and other sport balls. Referring to FIGS. 22-24, another valve 95 that may be utilized in sport ball 80, as well as sport balls 10 and 70, is depicted as having a valve housing 96 and a valve insert 97. Valve housing 96 includes a flange 98 that extends outward from a remainder of valve 95 and is secured to tie layer 62 with adhesive 61. Tie layer 62 is, in turn, thermal bonded to bladder 84. In other configurations, flange 98 may be directly secured to bladder 84 through adhesive or thermal bonding. Valve insert 97 permits an inflation apparatus to pressurize bladder 84 with a fluid, and valve insert 97 forms a seal to prevent the fluid from escaping. In addition to valve 95, any of the valve configurations depicted in U.S. Pat. Nos. 1,990,374; 2,318,115; 2,671,633; 3,100,641; 5,294,112; 7,082,958; and 7,517,294, for example, may also be utilized in various sport balls, including sport balls 10, 70, and 80.

The invention is disclosed above and in the accompanying drawings with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A sport ball comprising:

a casing that forms at least a portion of an exterior surface of the ball;

a bladder located within the casing for enclosing a pressurized fluid, the bladder including a first layer and a second layer, the first layer being formed of a first thermoplastic polymer material and the second layer being formed of an ethylene-vinyl alcohol copolymer;

a restriction structure located between the casing and the bladder; and a valve for introducing the fluid to the bladder, the valve being at least partially formed from a second thermoplastic polymer material; and the valve being secured to the bladder with a thermal bond and accessible from an exterior of the casing.

2. The sport ball recited in claim 1, wherein the first thermoplastic polymer material is a thermoplastic urethane.

3. The sport ball recited in claim 2, wherein the thermoplastic urethane is selected from a group consisting of polyester, polyether, polycaprolactone, polyoxypropylene and polycarbonate macroglycol based materials, and mixtures thereof.

4. The sport ball recited in claim 1, wherein the bladder includes a third layer, the third layer being formed of the first thermoplastic polymer material, and wherein the second layer is located between the first layer and the third layer.

5. The sport ball recited in claim 1, wherein the first layer is located exterior of the second layer.

6. The sport ball recited in claim 1, wherein a tie layer secures the valve to the first layer of the bladder, the tie layer being formed from the first thermoplastic polymer material.

7. The sport ball recited in claim 1, wherein the valve includes a flange that lays parallel to a surface of the bladder, the flange being secured to an outer surface of the bladder.

8. The sport ball recited in claim 1, wherein the valve includes a flange that lays parallel to an outer surface of the bladder, and a tie layer is located between the flange and the surface of the bladder, the tie layer bonding the valve to the bladder.

9. The sport ball recited in claim 1, wherein the valve includes a flange that lays adjacent to the first layer of the bladder, and a tie layer is located between the flange and the first layer of the bladder, the tie layer being joined to the flange with an adhesive bond, and the tie layer being joined to the first layer of the bladder with a thermal bond.

10. The sport ball recited in claim 1, wherein the valve is secured to the first thermoplastic polymer material of the bladder with the thermal bond.

11. The sport ball recited in claim 1, wherein the casing includes a plurality of panels joined along abutting edges.

12. The sport ball recited in claim 1, wherein the casing includes a vulcanized rubber element.

13. A sport ball comprising:

a casing that forms at least a portion of an exterior surface of the ball, the casing defining an aperture;

a bladder located within the casing for enclosing a pressurized fluid, the bladder including a first layer and a second layer, the first layer being formed from a first thermoplastic polymer material and the second layer being formed of an ethylene-vinyl alcohol copolymer; and a valve accessible through the aperture of the casing for introducing the fluid to the bladder, the valve being at least partially formed from a second thermoplastic polymer material;

wherein the valve is secured to the first thermoplastic polymer material of the bladder with a thermal bond; and wherein the first thermoplastic polymer material is a thermoplastic urethane.

14. The sport ball recited in claim 13, wherein the thermoplastic urethane of the first thermoplastic polymer material is selected from a group consisting of polyester, polyether, polycaprolactone, polyoxypropylene and polycarbonate macroglycol based materials, and mixtures thereof.

15. The sport ball recited in claim 13, wherein the casing includes a vulcanized rubber element.

16. The sport ball recited in claim 13, wherein the second thermoplastic polymer material is a thermoplastic urethane.

17. The sport ball recited in claim 16, wherein the thermoplastic urethane of the second thermoplastic polymer material is selected from a group consisting of polyester, polyether, polycaprolactone, polyoxypropylene and polycarbonate macroglycol based materials, and mixtures thereof.

18. The sport ball recited in claim 13, wherein the first layer is located exterior of the second layer.

19. The sport ball recited in claim 13, wherein the valve forms a flange that includes the second thermoplastic polymer material, the flange being thermal bonded to the first thermoplastic polymer material of the bladder to form the thermal bond.

20. The sport ball recited in claim 13, wherein a restriction structure is located between the casing and the bladder.

21. The sport ball recited in claim 13, wherein the casing includes a plurality of panels joined along abutting edges.

22. A sport ball comprising:

a casing that forms at least a portion of an exterior surface of the ball;

a bladder located within the casing for enclosing a pressurized fluid, the bladder including a first layer, a second layer, and a third layer, the first layer and the third layer being formed of a first thermoplastic polymer material, the second layer being formed of an ethylene-vinyl alcohol copolymer, wherein the second layer is located between the first layer and the third layer; and a valve for introducing the fluid to the bladder, the valve being formed from a second thermoplastic polymer material and accessible from an exterior of the casing;

wherein the first layer of the bladder is located exterior of the second layer of the bladder;

wherein the valve includes a flange that lays parallel to an outer surface of the bladder; and wherein the flange of the valve is secured to the first thermoplastic polymer material of the first layer on the outer surface of the bladder with a thermal bond.

23. The sport ball recited in claim 22, wherein the first thermoplastic polymer material is a thermoplastic urethane.

24. The sport ball recited in claim 23, wherein the thermoplastic urethane is selected from a group consisting of polyester, polyether, polycaprolactone, polyoxypropylene and polycarbonate macroglycol based materials, and mixtures thereof.

25. The sport ball recited in claim 22, wherein the casing includes a plurality of panels joined along abutting edges.

* * * * *